US011285360B2

(12) United States Patent
Lochhead

(10) Patent No.: US 11,285,360 B2
(45) Date of Patent: Mar. 29, 2022

(54) SHOULDER EXERCISE MACHINE

(71) Applicant: Angus Lochhead, Claremont, CA (US)

(72) Inventor: Angus Lochhead, Claremont, CA (US)

( * ) Notice: Subject to any disclaimer, the term of this patent is extended or adjusted under 35 U.S.C. 154(b) by 0 days.

(21) Appl. No.: 17/018,949

(22) Filed: Sep. 11, 2020

(65) Prior Publication Data

US 2020/0406087 A1 Dec. 31, 2020

Related U.S. Application Data

(63) Continuation-in-part of application No. 15/804,181, filed on Nov. 6, 2017, now Pat. No. 10,814,165.

(51) Int. Cl.

| | |
|---|---|
| ***A63B 21/04*** | (2006.01) |
| ***A63B 21/00*** | (2006.01) |
| ***A63B 23/035*** | (2006.01) |
| *A63B 23/12* | (2006.01) |

(52) U.S. Cl.

CPC .... *A63B 21/4045* (2015.10); *A63B 21/00069* (2013.01); *A63B 21/0414* (2013.01); *A63B 21/4035* (2015.10); *A63B 21/00061* (2013.01); *A63B 23/03508* (2013.01); *A63B 23/1263* (2013.01); *A63B 2225/05* (2013.01)

(58) Field of Classification Search

CPC ... A63B 23/1245; A63B 1/00; A63B 21/0414; A63B 21/4045; A63B 21/4035; A63B 23/03508; A63B 21/0557; A63B 21/00069; A63B 21/00061; A63B 23/1263; A63B 2225/05; A63B 21/00065; A63B 2209/00; A63B 21/0552; A63B 2209/10; A63B 23/1209

See application file for complete search history.

(56) References Cited

U.S. PATENT DOCUMENTS

| | | | | |
|---|---|---|---|---|
| 3,658,327 A * | 4/1972 | Thiede | A63B 21/154 482/96 |
| 4,101,124 A * | 7/1978 | Mahnke | A63B 21/068 482/96 |
| 4,111,417 A * | 9/1978 | Gardner | A63B 21/05 482/128 |

(Continued)

OTHER PUBLICATIONS

Product Title: NML—2805—Axial Shoulder Exerciser Website: http://www.narang.com/physiotherapy-equipments/shoulder-arm-hand-exercise-equipments/index.php Site visited: Aug. 28, 2017.

(Continued)

*Primary Examiner* — Garrett K Atkinson
(74) *Attorney, Agent, or Firm* — Eric Kelly

(57) ABSTRACT

Shoulder exercising machines (machines) may include an upper member, a lower member, and a resistance member. The upper member and the lower member may be slidingly engaged with each other. The resistance member may provide resistance with respect to the upper member sliding against the lower member. The resistance member may be at least one elongate elastic member with two opposing terminal ends. The upper member may have at least one handle and an upper surface for supporting at least a portion of a forearm and/or a wrist of a user during exercises with the machine. The user may push or pull the handle and slide the upper member with respect to the lower member while experiencing resistance due to the resistance member.

20 Claims, 35 Drawing Sheets

(56) References Cited

U.S. PATENT DOCUMENTS 4,541,627 A * 9/1985 MacLean ..... A63B 22/0076 482/112
4,772,015 A * 9/1988 Carlson ..... A63B 23/12 482/902
4,865,317 A * 9/1989 Hickey ..... A63B 21/05 482/126
4,944,508 A 7/1990 Collins
5,295,931 A * 3/1994 Dreibelbis ..... A63B 21/1609 482/125
D348,495 S 7/1994 McCoy
5,558,624 A 9/1996 Hepburn
5,580,341 A 12/1996 Simonson
5,645,521 A 7/1997 Hepburn
5,667,464 A 9/1997 Simonson
5,713,823 A 2/1998 Walendzak
5,749,815 A * 5/1998 Lipps ..... A63B 21/4035 482/122
5,971,896 A 10/1999 Giannelli
6,071,217 A * 6/2000 Barnett ..... A63B 21/0552 482/121
6,206,811 B1 * 3/2001 Lat ..... A63B 21/0004 482/126
D440,611 S 4/2001 Batca
6,251,879 B1 6/2001 May
6,254,516 B1 7/2001 Giannelli
6,824,498 B2 11/2004 Hassler
6,976,942 B2 * 12/2005 Kennedy ..... A63B 21/00043 482/122
6,981,932 B1 * 1/2006 Huang ..... A63B 21/00072 482/121
7,108,664 B2 9/2006 Mason
7,331,911 B2 2/2008 Webber
7,438,673 B1 * 10/2008 Jones ..... A63B 22/203 482/51
7,674,211 B2 * 3/2010 Uygan ..... A63B 23/00 482/123
7,717,832 B2 5/2010 Webber
7,717,834 B2 5/2010 Kay
7,803,095 B1 * 9/2010 LaGree ..... A63B 22/0012 482/140
7,976,444 B2 * 7/2011 Binns ..... A61H 1/0281 482/114
8,641,585 B2 * 2/2014 LaGree ..... A63B 22/0087 482/94
8,721,511 B2 * 5/2014 Endelman ..... A63B 21/156 482/142
9,022,909 B2 * 5/2015 Kermath ..... A63B 22/0089 482/133
9,072,931 B2 * 7/2015 Lagree ..... A63B 21/4035
9,079,071 B2 * 7/2015 Allain ..... A63B 21/4045
9,180,332 B1 * 11/2015 Tenorio ..... A63B 21/4045
9,283,422 B2 * 3/2016 Lagree ..... A63B 21/00065
9,456,951 B2 10/2016 Stevenot
9,579,555 B2 * 2/2017 Lagree ..... A63B 21/00061
9,604,097 B1 * 3/2017 Lagree ..... A63B 22/0089
D783,741 S 4/2017 Moschel
9,776,062 B2 * 10/2017 Lagree ..... A63B 21/00061
9,868,011 B2 * 1/2018 Lagree ..... A63B 21/023
9,962,592 B2 * 5/2018 Lagree ..... A63B 21/151
10,052,518 B2 * 8/2018 Lagree ..... A63B 22/0087
10,124,232 B2 * 11/2018 Lagree ..... A63B 21/4045
10,201,724 B2 * 2/2019 Lagree ..... A63B 21/4045
10,272,285 B2 * 4/2019 Lagree ..... A63B 71/0622
10,426,991 B2 * 10/2019 Barnett ..... A63B 21/0552
2004/0097349 A1 5/2004 Rogers
2006/0199712 A1 * 9/2006 Barnard ..... A63B 22/0007 482/142
2010/0227744 A1 9/2010 Dang
2011/0172069 A1 * 7/2011 Gerschefske ..... A63B 22/0089 482/139
2012/0295771 A1 * 11/2012 LaGree ..... A63B 21/4029 482/94
2013/0284182 A1 10/2013 Valdez
2014/0121076 A1 * 5/2014 Lagree ..... A63B 21/4045 482/123
2014/0121079 A1 * 5/2014 Lagree ..... A63B 22/0046 482/139
2014/0141948 A1 * 5/2014 Aronson ..... A63B 21/0428 482/128
2015/0024914 A1 * 1/2015 Lagree ..... A63B 22/0089 482/142
2015/0057127 A1 * 2/2015 Lagree ..... A63B 21/00 482/4
2015/0065318 A1 * 3/2015 Lagree ..... A63B 21/4045 482/130
2015/0072841 A1 * 3/2015 Lagree ..... A63B 21/152 482/139
2015/0202484 A1 * 7/2015 Lalaoua ..... A63B 23/03541 482/127
2015/0246263 A1 * 9/2015 Campanaro ..... A63B 21/068 482/52
2015/0297944 A1 * 10/2015 Lagree ..... A63B 21/4035 482/145
2016/0008657 A1 * 1/2016 Lagree ..... A63B 21/023 482/130
2016/0193496 A1 * 7/2016 Lagree ..... A63B 21/0552 482/123
2016/0361602 A1 * 12/2016 Lagree ..... A61B 5/375
2017/0014667 A1 * 1/2017 Barnett ..... A63B 23/03525
2017/0014672 A1 * 1/2017 Lagree ..... A63B 21/0428
2017/0189257 A1 7/2017 Lan

OTHER PUBLICATIONS

Product Title: OfficeGYM the Office Chair Trainer Website: https://www.amazon.com/OfficeGYM-the-Office-Chair-Trainer/dp/B00FKF4CKO Site visited: Aug. 28, 2017.
Website: http://www.narang.com/physiotherapy-equipments/shoulder-arm-hand-exercise-equipments/index.php Site visited: Aug. 28, 2017.
Product Title: Exer III—Table-Top Upper Extremities Exerciser Website: https://www.medpluspro.com/exer-iii-table-top-upper-extremeties-exerciser.html Site visited: Aug. 28, 2017 And website: https://www.massagesupplies.com/product/9986/Site visited: Nov. 1, 2017.
Product Title: Stamina InStride Folding Cycle Website: https://www.walmart.com/ip/Stamina-InStride-Folding-Cycle/14906798 Site visited: Aug. 28, 2017.

* cited by examiner

SHOULDER EXERCISE MACHINE

PRIORITY NOTICE

The present patent application is a continuation-in-part (CIP) of U.S. non-provisional patent application Ser. No. 15/804,181 filed on Nov. 6, 2017, and claims priority to said U.S. non-provisional patent application under 35 U.S.C. § 120. The above-identified patent application is incorporated herein by reference in its entirety as if fully set forth below.

TECHNICAL FIELD OF THE INVENTION

The present invention relates in general to machines or apparatus for exercising the shoulder and more specifically to a shoulder exercise machine for exercising and/or rehabilitating a single shoulder region.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Existing shoulder exercise machines are generally designed for weight lifting (body building) and are not suitable for therapeutic and rehabilitation uses wherein the user may be very weak, such as when the user may be recovering from a stroke, from surgery, and/or from an injury. Because existing shoulder exercise machines are generally for serving unimpaired users (e.g., weight lifters or otherwise healthy adults), these machines often have the following problems: are relatively large, heavy, and/or cumbersome; are not readily portable (e.g., often requiring more than one person to transport); often are for exercising both shoulder regions at once, rather than just one single shoulder region; are often mechanically complex; complex to use; complex to setup; are often expensive; allow for too great a range of motion (e.g., free weights); do not provide support for the forearm and/or wrist during exercises, that permits primary focus on muscles of the shoulder region; and do not provide for very low exercising resistances suitable for an impaired and/or recovering user.

There is a need in the art for a shoulder exercise machine designed specifically for impaired and/or recovering users that can provide at very low resistance (to moderate resistance) for exercises and that does not share the numerous problems noted above.

It is to these ends that the present invention has been developed.

BRIEF SUMMARY OF THE INVENTION

To minimize the limitations in the prior art, and to minimize other limitations that will be apparent upon reading and understanding the present specification, embodiments of the present invention may describe shoulder exercising machines (machines). In some embodiments, such machines might comprise: an upper member, a lower member, and a resistance member. In some embodiments, the upper member and the lower member may be in slidingly engaged with each other. In some embodiments, the resistance member may provide resistance with respect to the upper member sliding against the lower member. In some embodiments, the resistance member may be at least one elongate elastic member with two opposing terminal ends. In some embodiments, these terminal ends may be removably attached to the lower member, while different portions of the resistance member may be retained with the upper member. In some embodiments, the upper member may have a handle and an upper surface for supporting at least a portion of a forearm of a user during exercises with the machine. In some embodiments, the user may push or pull on this handle resulting in sliding of the upper member with respect to the lower member while experiencing resistance due to the resistance member.

It is an objective of the present invention to provide a shoulder exercising machine that may be used to exercise one shoulder region at a time, i.e., not both shoulders.

It is another objective of the present invention to provide a shoulder exercising machine that may be relatively small, as compared against prior art shoulder exercise machines.

It is another objective of the present invention to provide a shoulder exercising machine that may be lightweight and readily portable (mobile).

It is another objective of the present invention to provide a shoulder exercising machine that may be easy to use.

It is another objective of the present invention to provide a shoulder exercising machine that may be simple to setup, with minimal setup steps.

It is another objective of the present invention to provide a shoulder exercising machine that may be used with push or with pull motions of the user's single arm.

It is another objective of the present invention to provide a shoulder exercising machine that only permits a controlled linear back and forth range of motion.

It is another objective of the present invention to provide a shoulder exercising machine that may provide forearm and/or wrist support, during exercising, so that the user does not have to spend energy and/or effort at self-supporting their forearm and/or wrist or, to reduce the effects gravity on the user's forearm and/or wrist; thereby further isolating the muscles of the shoulder region for rehabilitation purposes, such as, but not limited to, recovering from a stroke, an injury, and/or from recovering from surgery.

It is another objective of the present invention to provide a shoulder exercising machine that may have a variety of different and interchangeable handles.

It is yet another objective of the present invention to provide a shoulder exercising machine that offers at least very low resistances (to moderate resistances, if desired), suitable for a user to use for rehabilitation purposes, such as, but not limited to, recovering from a stroke, an injury, and/or from recovering from surgery.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

REFERENCE NUMERALS

Figure 1A:
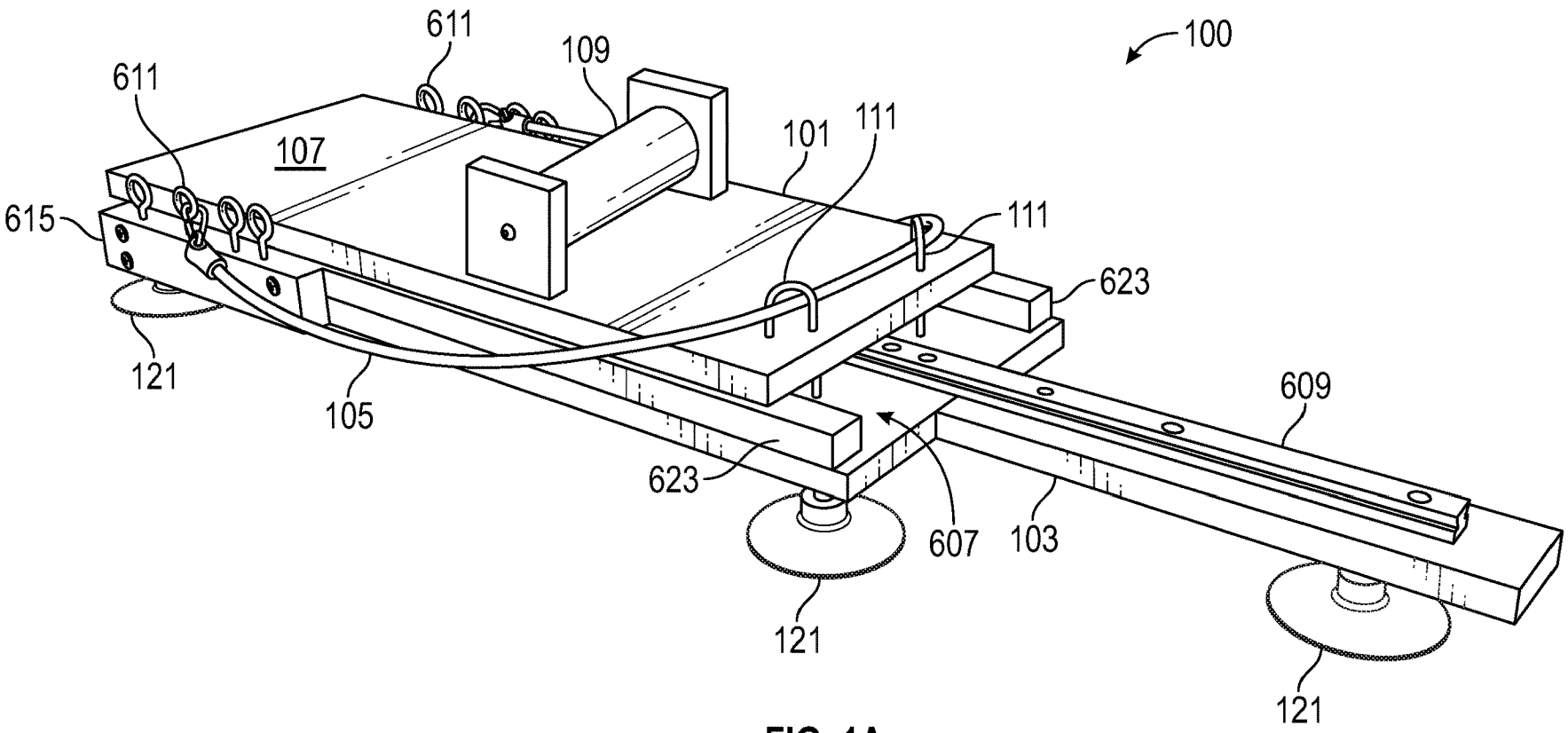
FIG. 1A may show an embodiment of a shoulder exercise machine from a perspective view.

100 shoulder exercise machine 100
101 upper member 101

103 lower member 103
105 resistance member 105
107 upper-member-upper-surface 107
109 handle 109
111 retainer guide 111
121 feet 121
125 cushion 125
405 plurality of resistance members 405
505 terminal end 505
511 anchor receiver 511
607 lower-member-upper-surface 607
609 second sliding mechanism 609
611 anchor 611
613 stop 613
615 anchor-support-blocks 615
617 neck-region 617
623 supports-for-upper-member 623
707 upper-member-lower-surface 707
709 first sliding mechanism 709
713 stop 713
807 lower-member-lower-surface 807
819 elongate-structural-member 819
821 feet 821
900 shoulder exercise machine 900
901 upper member 901
907 upper-member-upper-surface 907
909*a* handle 909*a*
909*b* handle 909*b*
910 central vertical member 910
911 horizontal handle 911
913 vertical handle 913
915 lever 915
917 friction knob 917
921 channel 921
9901 user 9901
9903 forearm 9903
9905 hand 9905

DETAILED DESCRIPTION OF THE INVENTION

Note, the terms used herein, for example those associated with reference numerals, are intended to be named with descriptive names that should imply structure and/or function of those named terms. For example, and without limiting the scope of the present invention, the term, "upper-member-upper-surface 107," is an upper surface of upper member 101 as the term implies.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention.

Figure 1B:
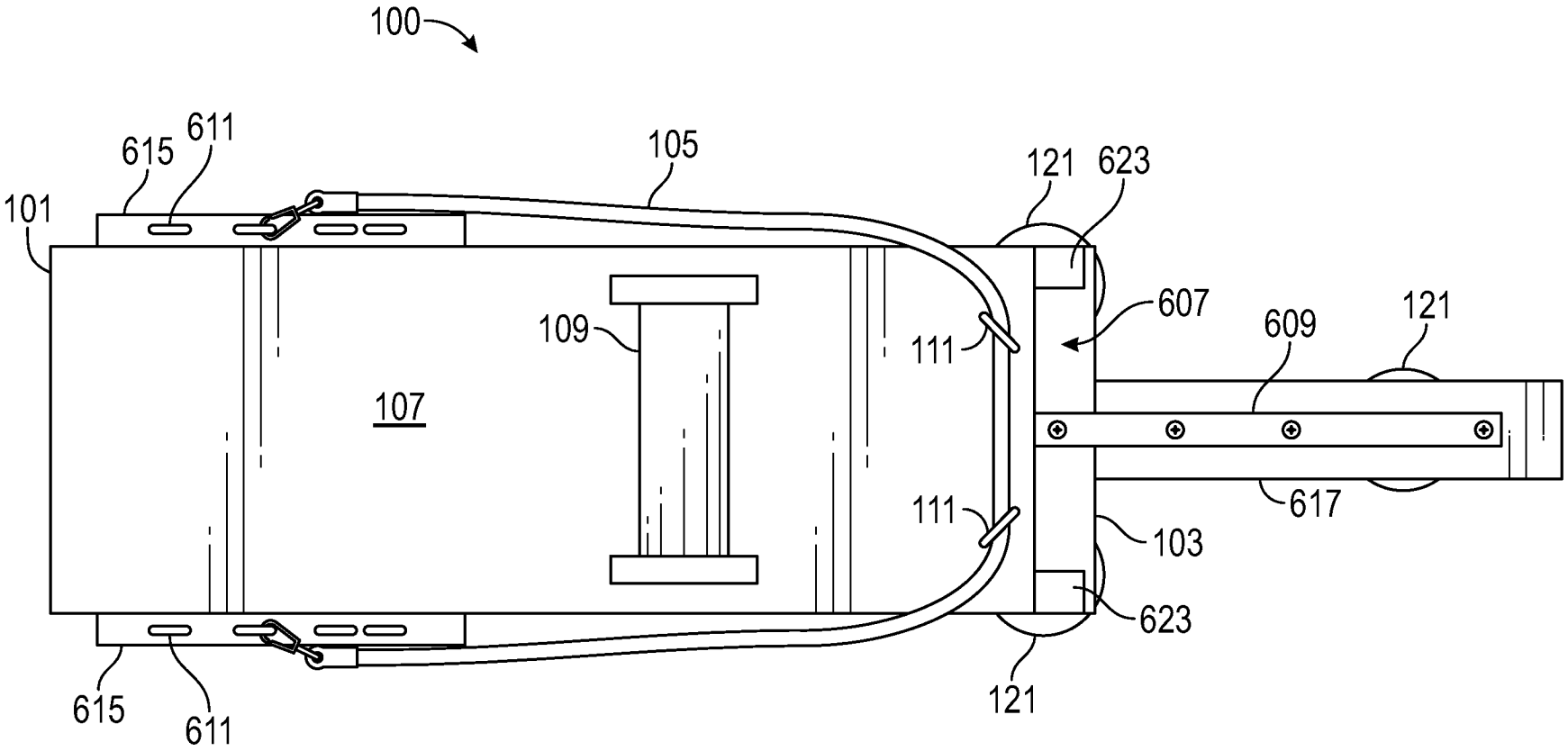
FIG. 1B may show the shoulder exercise machine of FIG. 1A from a top view.
Figure 1C:
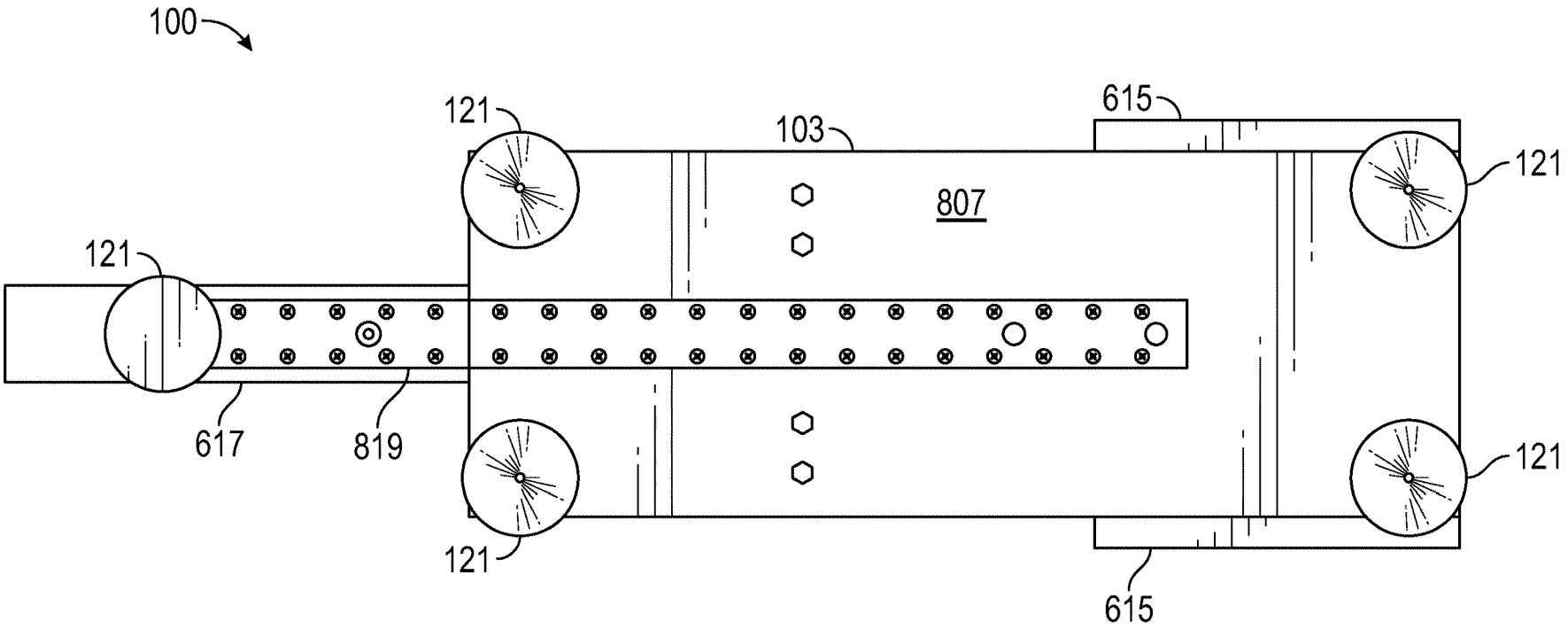
FIG. 1C may show the shoulder exercise machine of FIG. 1A from a bottom view.
Figure 1D:
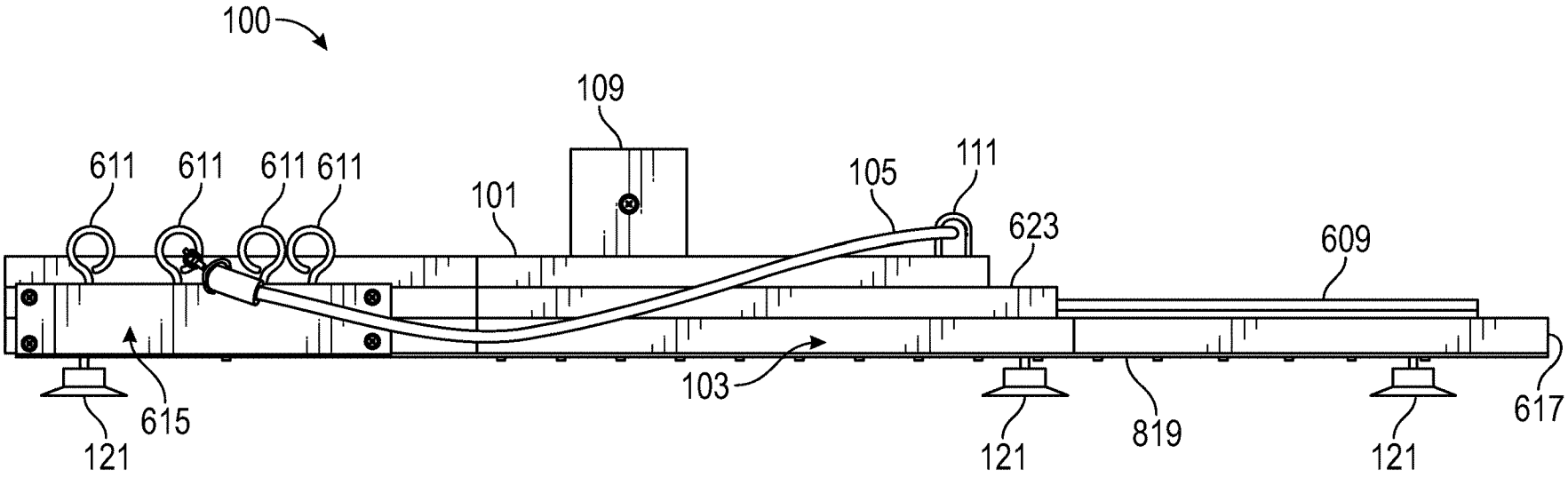
FIG. 1D may show the shoulder exercise machine of FIG. 1A from a longitudinal side view (left or right).
Figure 1E:
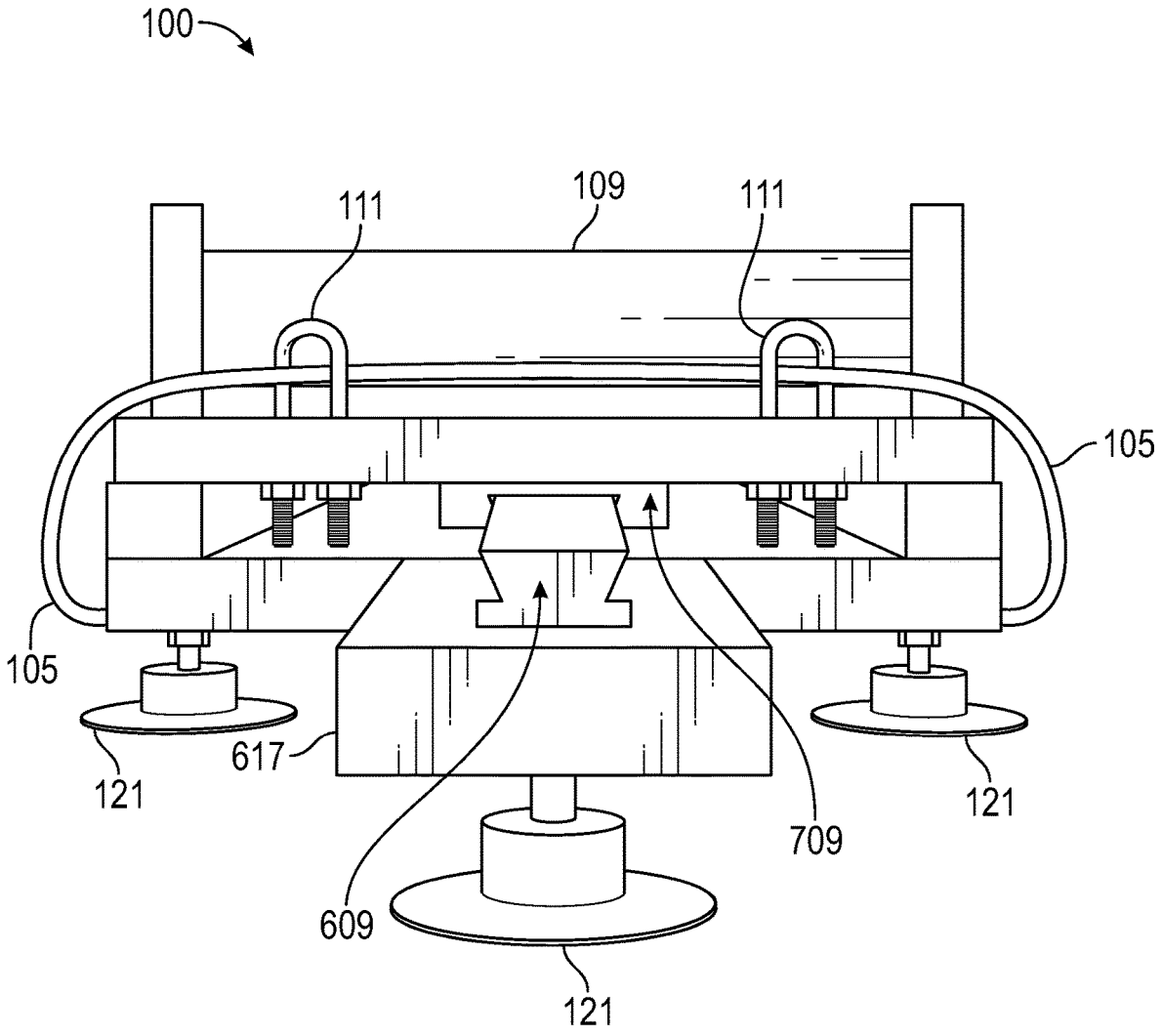
FIG. 1E may show the shoulder exercise machine of FIG. 1A from a front view.
Figure 1F:
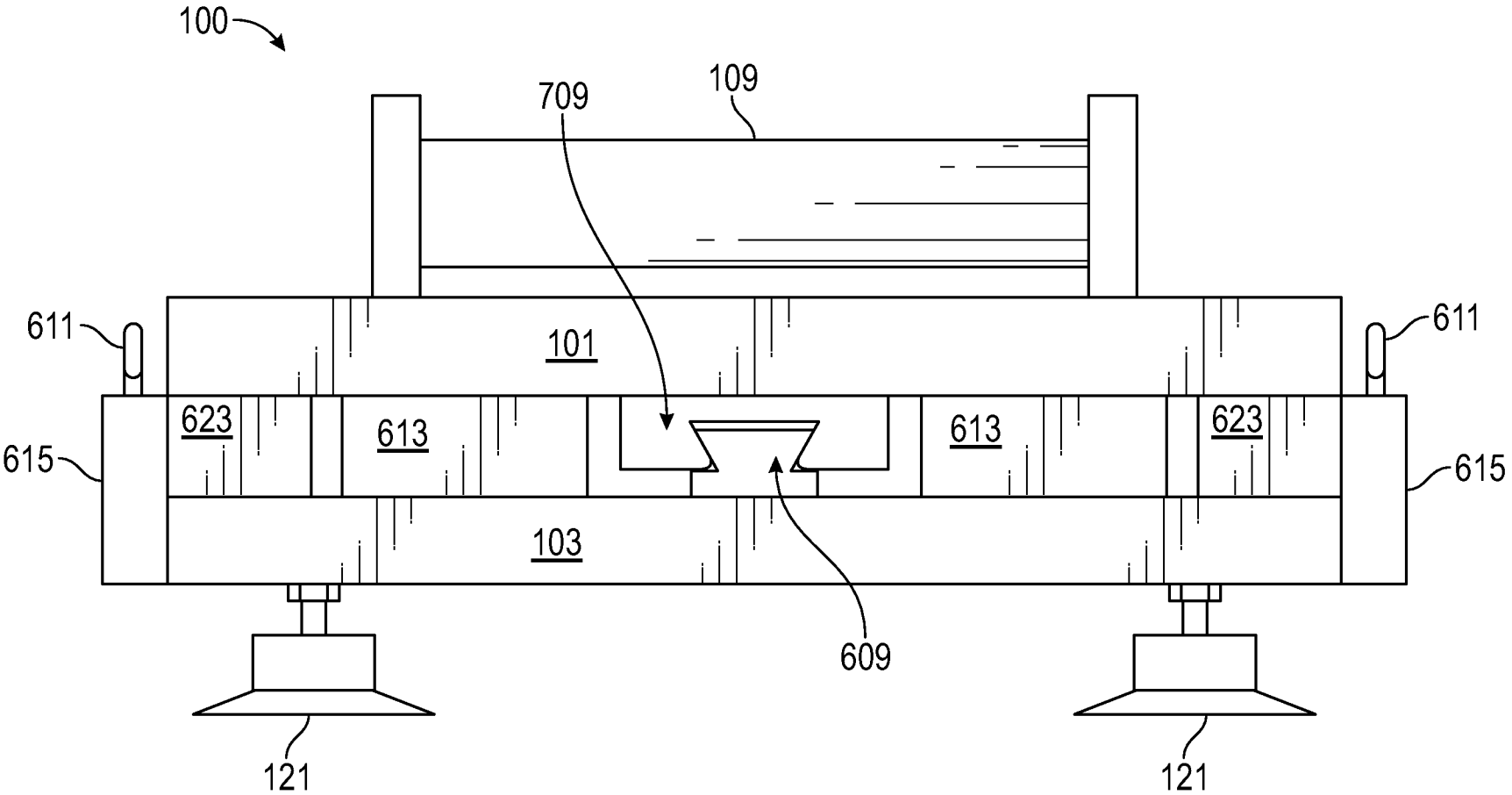
FIG. 1F may show the shoulder exercise machine of FIG. 1A from a rear (back) view.
Figure 1G:
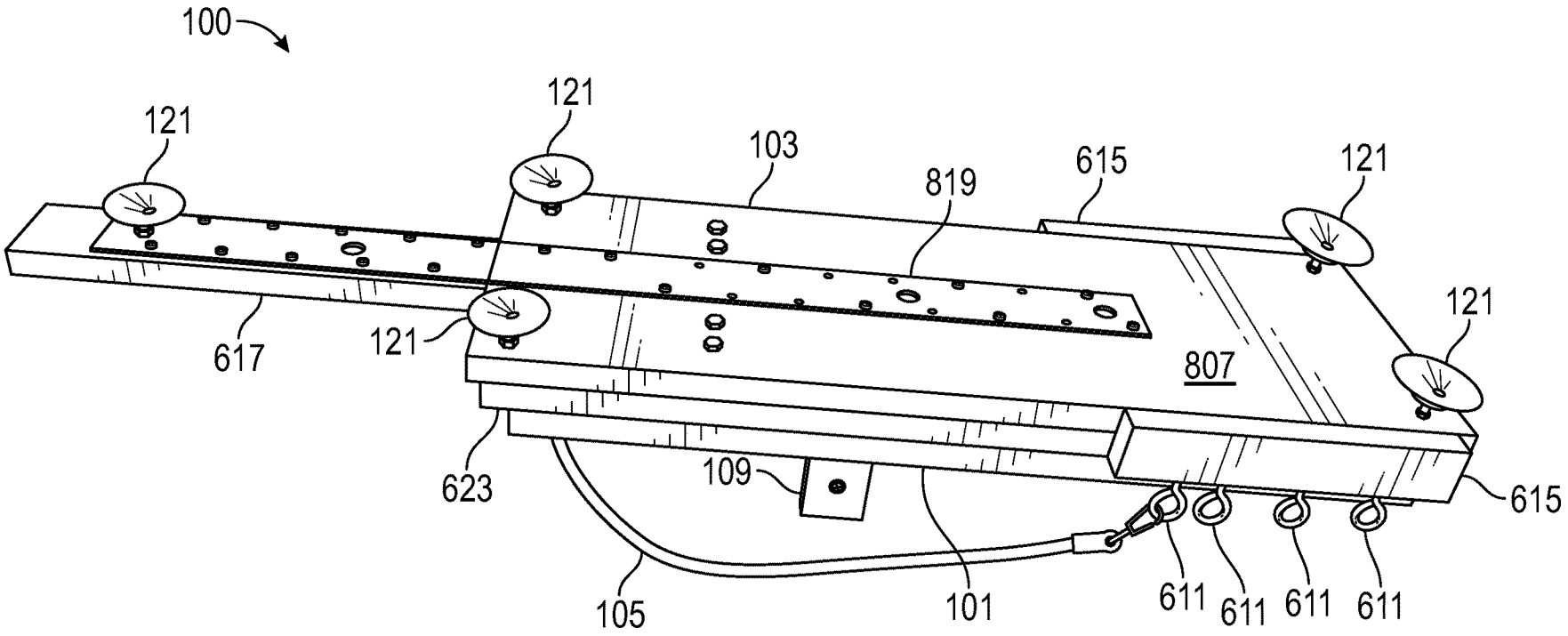
FIG. 1G may show the shoulder exercise machine of FIG. 1A from a bottom perspective view.

FIG. 1A may show an embodiment of a shoulder exercise machine 100 from a perspective view. FIG. 1B may show shoulder exercise machine 100 from a top view. FIG. 1C may show shoulder exercise machine 100 from a bottom view. FIG. 1D may show shoulder exercise machine 100 from a longitudinal side view (left or right). FIG. 1E may show shoulder exercise machine 100 from a front view. FIG. IF may show shoulder exercise machine 100 from a rear (back) view. FIG. 1G may show shoulder exercise machine 100 from a bottom perspective view.

In some embodiments, shoulder exercise machine 100 may be a single arm shoulder press exercise machine. In some embodiments, shoulder exercise machine 100 may be a single arm row exercise machine. In some embodiments, shoulder exercise machine 100 may be a horizontal single arm shoulder press exercise machine. In some embodiments, shoulder exercise machine 100 may be a horizontal single arm row exercise machine. That is, in some embodiments, sliding motion of portions of machine 100 may move a generally horizontal plane. In some embodiments, machine 100 may be for exercising a single shoulder region at a time (see e.g., FIG. 2A and/or FIG. 3A). In some embodiments, shoulder exercise machine 100 may be known as machine 100.

In some embodiments, machine 100 may comprise: an upper member 101, a lower member 103, and a resistance member 105. In some embodiments, upper member 101 and lower member 103 may be in slidingly engaged with each other. In some embodiments, resistance member 105 may provide resistance with respect to the upper member 101 sliding against lower member 103. In some embodiments, resistance member 105 may be at least one elongate elastic member with two opposing terminal ends 505 (see FIG. 5A for terminal end 505). In some embodiments, aside from terminal ends 505, resistance member 105 may be substantially constructed from one or more elastic materials, such as, but not limited, to silicones, rubbers, and/or elastic plastics. In some embodiments, elastic properties of resistance member 105 may be achieved with coil/helix spring(s) (sheathed or unsheathed). See e.g., FIG. 1A, FIG. 1B, FIG. 1D, FIG. 1E, FIG. 1F, and FIG. 1G. See also FIG. 2A through FIG. 2D for figures showing this sliding translation in use with pushing exercises. See also FIG. 3A through FIG. 3D for figures showing this sliding translation in use with pulling exercises.

In some embodiments, upper member 101 may be a sled and/or function as a sled and/or be known as a sled. In some embodiments, upper member 101 may be substantially shaped as a rectangular prism member (not including handle 109 nor retainer guides 111). In some embodiments, upper member 101 may be rigid to substantially semi-rigid. In some embodiments, upper member 101 (not including handle 109 nor retainer guides 111) may be substantially constructed from one or more of: plastic, metal, and/or wood. In some embodiments, upper member 101 may comprise an upper-member-upper-surface 107 that may be an upper surface of the upper member 101. In some embodiments, upper-member-upper-surface 107 may be substantially planar. In some embodiments, upper-member-upper-surface 107 may be substantially flat (aside from a handle 109 and retainer guides 111). See e.g., FIG. 1A, FIG. 1B, and FIG. 1D. In some embodiments, a portion of upper-member-upper-surface 107 may support at least a portion of a wrist of a user 9901 during exercising use of the machine 100. In some embodiments, a portion of upper-member-upper-surface 107 may support at least a portion of a lower forearm 9903 of a user 9901 during exercising use of the machine 100. See also FIG. 2A through FIG. 2D for figures showing forearm 9903 being supported by portions of upper-member-upper-surface 107. In some embodiments, at least some portions of upper-member-upper-surface 107 may be covered in a covering. This covering may be one or more of: padding, cushioning, foam, and/or fabric. In some embodiments, this covering may provide comfort to forearm 9903 of user 9901; and/or may provide a surface that may be readily wiped down and sanitized.

In some embodiments, upper-member-upper-surface 107 may comprise a handle 109. In some embodiments, handle 109 may be mounted to upper-member-upper-surface 107. In some embodiments, at least a portion of handle 109 may be covered by a foam covering to provide comfort to user 9901. In some embodiments, handle 109 may be sized to be gripped by at least one hand 9905 of user 9901. See e.g., FIG. 1A and FIG. 1B. This handle 109, during exercise use of machine 100 may be removably engaged by a hand 9905 of user 9901. See also FIG. 2A through FIG. 2D for figures showing handle 109 in use with pushing exercises. See also FIG. 3A through FIG. 3D for figures showing handle 109 in use with pulling exercises.

In some embodiments, upper member 101 may comprise at least one retainer guide 111 for retaining a portion of resistance member 105. In some embodiments, at least one retainer guide 111 may be located on upper-member-upper-surface 107. In some embodiments, retainer guide 111 may be loop or a ring; wherein the portion of resistance member 105 may pass through this loop or ring. In some embodiments, this portion of resistance member 105 that may pass through this loop or this ring of retainer guide 111 may do so in a sliding translation manner. In some embodiments, there may be at least two spaced retainer guides 111. See e.g., FIG. 1A and FIG. 1B. In some embodiments, spacing between these at least two spaced retainer guides 111 may be such that a width (or a diameter) of forearm 9903 may fit comfortably between these two retainer guides 111. See e.g., FIG. 3A and FIG. 3B.

In some embodiments, lower member 103 may comprise a lower-member-lower-surface 807. Lower-member-lower-surface 807 may be a lower surface of lower member 103. See e.g., FIG. 1C and FIG. 1G. In some embodiments, lower-member-lower-surface 807 may comprise at least three feet 121. In some embodiments, feet 121 may permit machine 100 to rest upon a supportive surface. This supportive substrate may be selected from: table tops, bench tops, desk tops, counter tops, chest tops, dresser tops, pedestal tops, stand tops, the floor, the ground, and/or the like. In some embodiments, feet 121 may have non-slip and/or non-skid properties. In some embodiments, feet 121 may permit removable attachment of lower member 103 to this supportive substrate. In some embodiments, feet 121 may be suctions cups. In some embodiments, feet 121 may be mounting blocks. In some embodiments, feet 121 may be clamps.

In some embodiments, lower member 103 may comprise lower-member-lower-surface 807; wherein lower-member-lower-surface 807 may comprise an elongate-structural-member 819. In some embodiments, elongate-structural-member 819 may be structural reinforcement. In some embodiments, elongate-structural-member 819 may be rigid to substantially semi-rigid. In some embodiments, elongate-structural-member 819 may be substantially constructed from one or more of plastic, metal, and/or wood. In some embodiments, elongate-structural-member 819 may be substantially shaped as a rectangular prism member. In some embodiments, elongate-structural-member 819 may be substantially flat and/or planar. In some embodiments, a neck-region 617 of lower member 103 (see FIG. 6A for neck region 617) may be supported by a portion of elongate-structural-member 819; wherein elongate-structural-member 819 may provide structural strength to neck-region 617. See e.g., FIG. 1C and FIG. 1G.

Figure 1H:
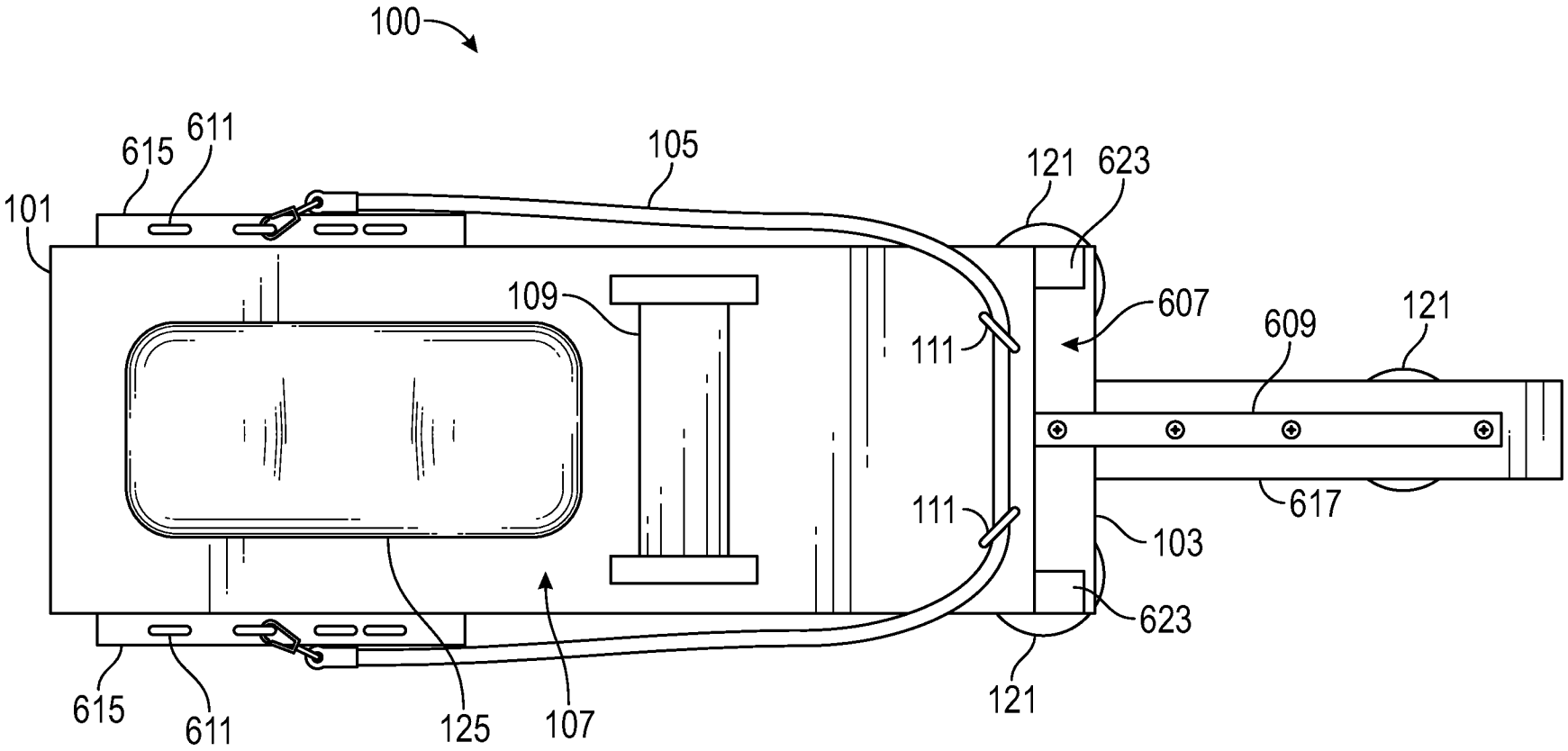
FIG. 1H may show the shoulder exercise machine of FIG. 1A from a top view and with a gel-pad cushion.

FIG. 1H may show machine 100 from the top view and with a cushion 125. In some embodiments, cushion 125 may serve a function to provide comfort to and/or to protect user 9901. User 9901 may have skin and/or tissue proximate to the skin that may be fragile, e.g., thin skin and/or prone to bruising. Use of cushion 125 may help to alleviate some such problems with user 9901 by providing a region of comfortable padding to user 9901's forearm 9903 regions. In some embodiments, cushion 125 may be attached to a portion of upper-member-upper-surface 107. In some embodiments, cushion 125 may be removably attached to a portion of upper-member-upper-surface 107; such as by Velcro or Velcro like (e.g., using a plurality of hooks that removably attach with a complimentary plurality of loops, wherein such hooks and loops are attached to opposing but mating surfaces), snaps, buttons, zippers, and/or other similar mechanical fasteners. In some embodiments, cushion 125 may have a substantially smooth exterior surface that lends itself to being wiped down for cleaning and/or sanitation purposes. In some embodiments, cushion 125 may have padding from foam and/or from batting. In some embodiments, cushion 125 may be a gel-pad. In some embodiments, cushion 125 may be a gel-pad that may be heated (e.g., by microwave or by hot water) or cooled (e.g., by freezing).

Figure 2A:
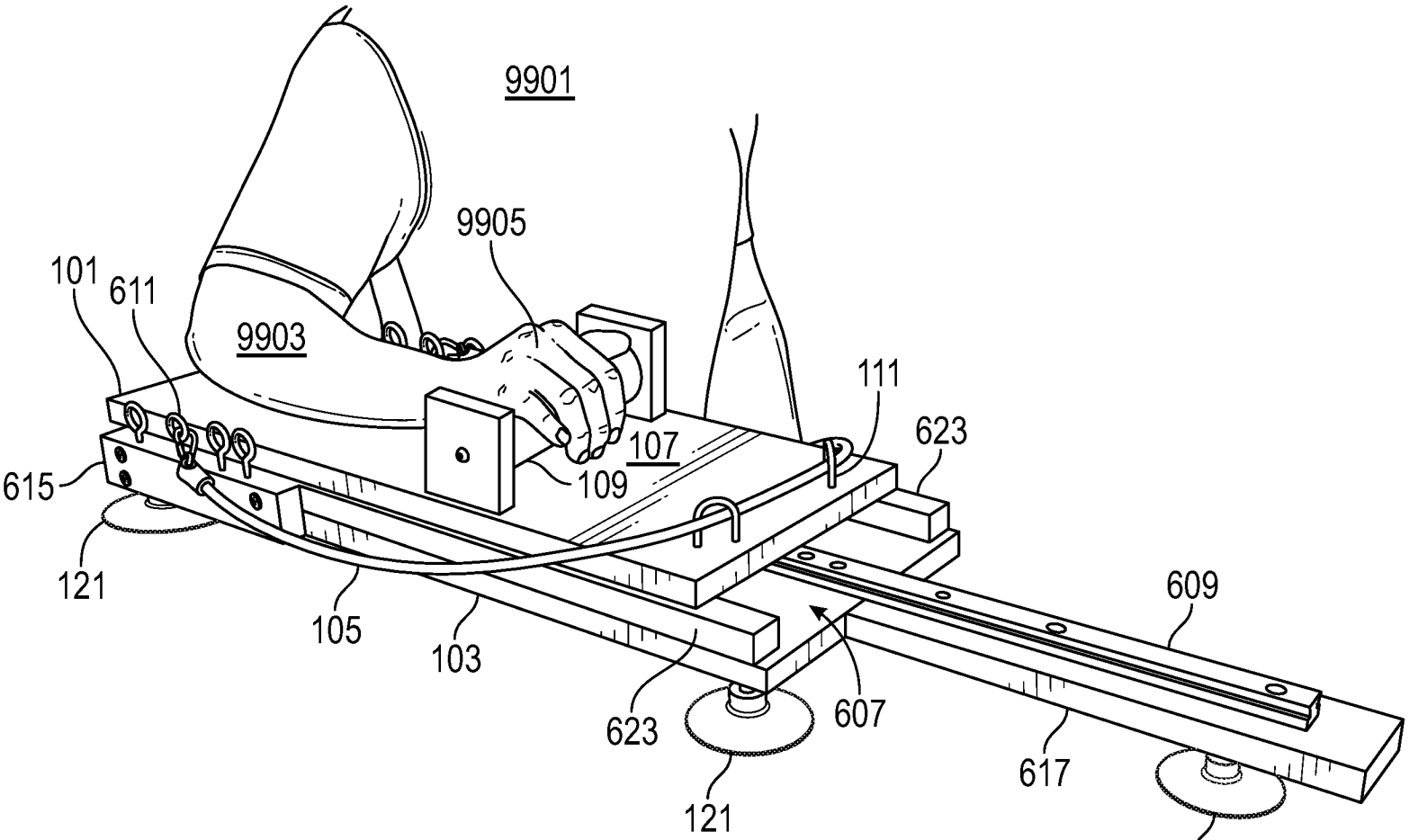
FIG. 2A may show the shoulder exercise machine of FIG. 1A in use, prior to the user pushing against a handle, from a perspective view.
Figure 2B:
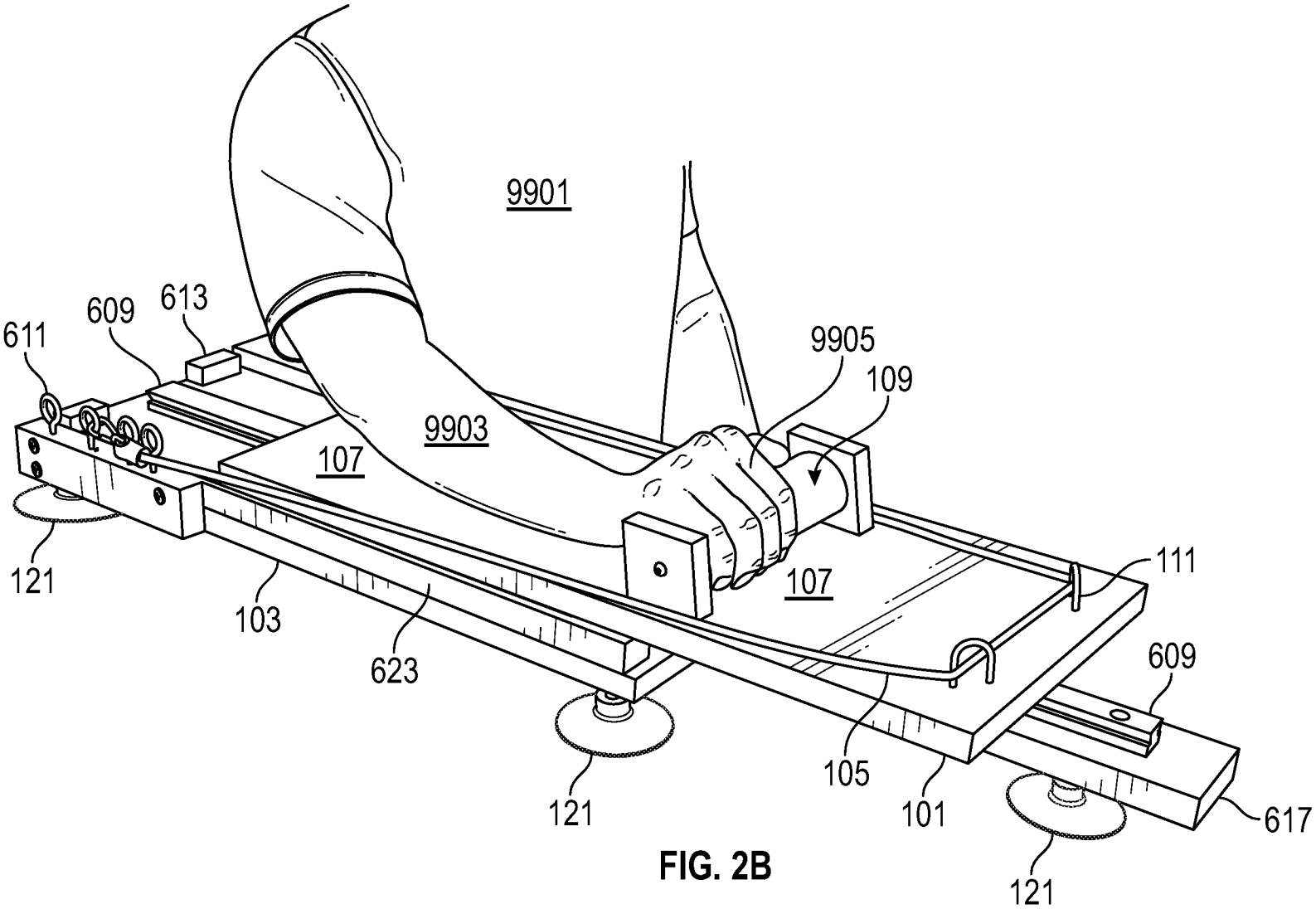
FIG. 2B may show the shoulder exercise machine of FIG. 1A in use, while user may be pushing against a handle, from a perspective view.
Figure 2C:
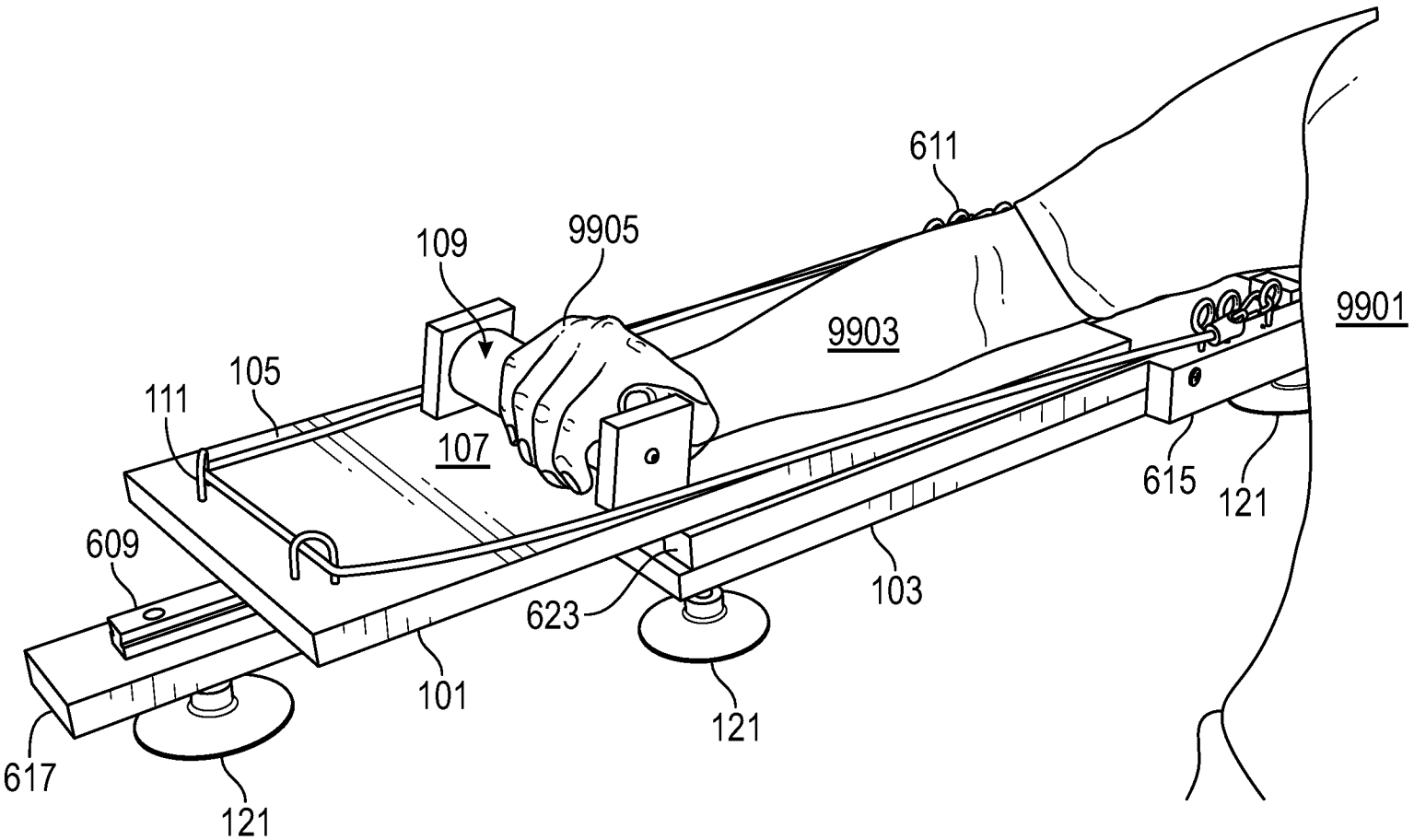
FIG. 2C may show the shoulder exercise machine of FIG. 1A in use, while user may be pushing against a handle, from a different perspective view.
Figure 2D:
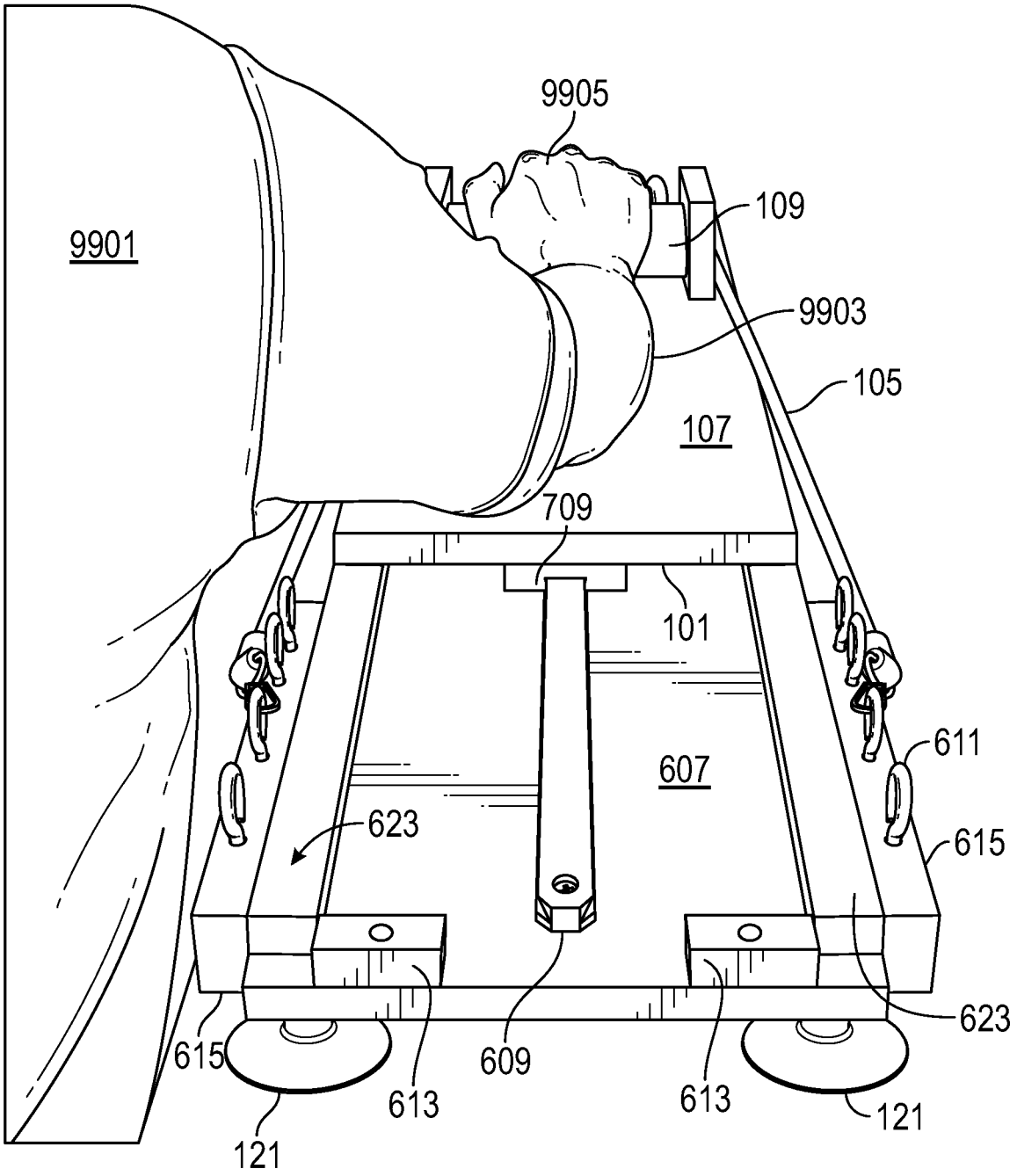
FIG. 2D may show the shoulder exercise machine of FIG. 1A in use, while user may be pushing against a handle, from a rear (back) view.

FIG. 2A may show shoulder exercise machine 100 in use, prior to user 9901 pushing against handle 109, from a perspective view. FIG. 2B may show shoulder exercise machine 100 in use, while user 9901 may be pushing against handle 109, from a perspective view. FIG. 2C may show shoulder exercise machine 100 in use, while user 9901 may be pushing against handle 109, from a different perspective view. FIG. 2D may show shoulder exercise machine 100 in use, while user 9901 may be pushing against handle 109, from a rear (back) view. In FIG. 2A, user 9901 may not be exerting any pressure on handle 109. Whereas, in FIG. 2B through FIG. 2D, user 9901 may be pushing against handle 109. Such pushing against handle 109 by user 9901, may be pushing against inherent elastic resistance present in resistance member 105; and thus, exercise of the shoulder region, of a single shoulder region, may be achieved. Note, in some embodiments, for such pushing exercising to function, lower member 103 of machine 100 may need to fixed with respect to the supportive substrate that may be supporting machine 100. For example, and without limiting the scope in the present invention, this may be accomplished by feet 121 being suction cups or mounting blocks or clamps that are attached to the supportive substrate.

Figure 3A:
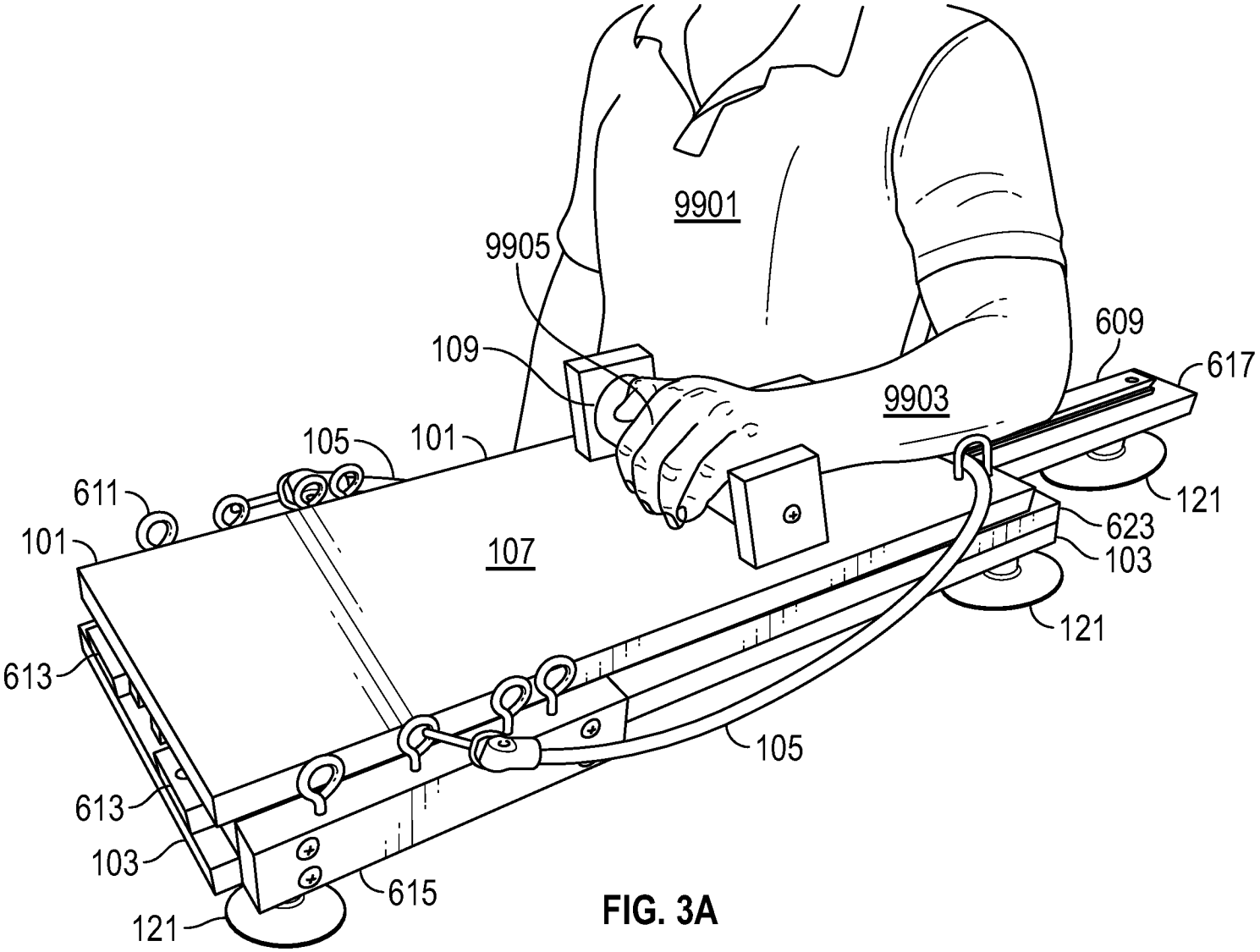
FIG. 3A may show the shoulder exercise machine of FIG. 1A in use, prior to the user pulling against a handle, from a perspective view.
Figure 3B:
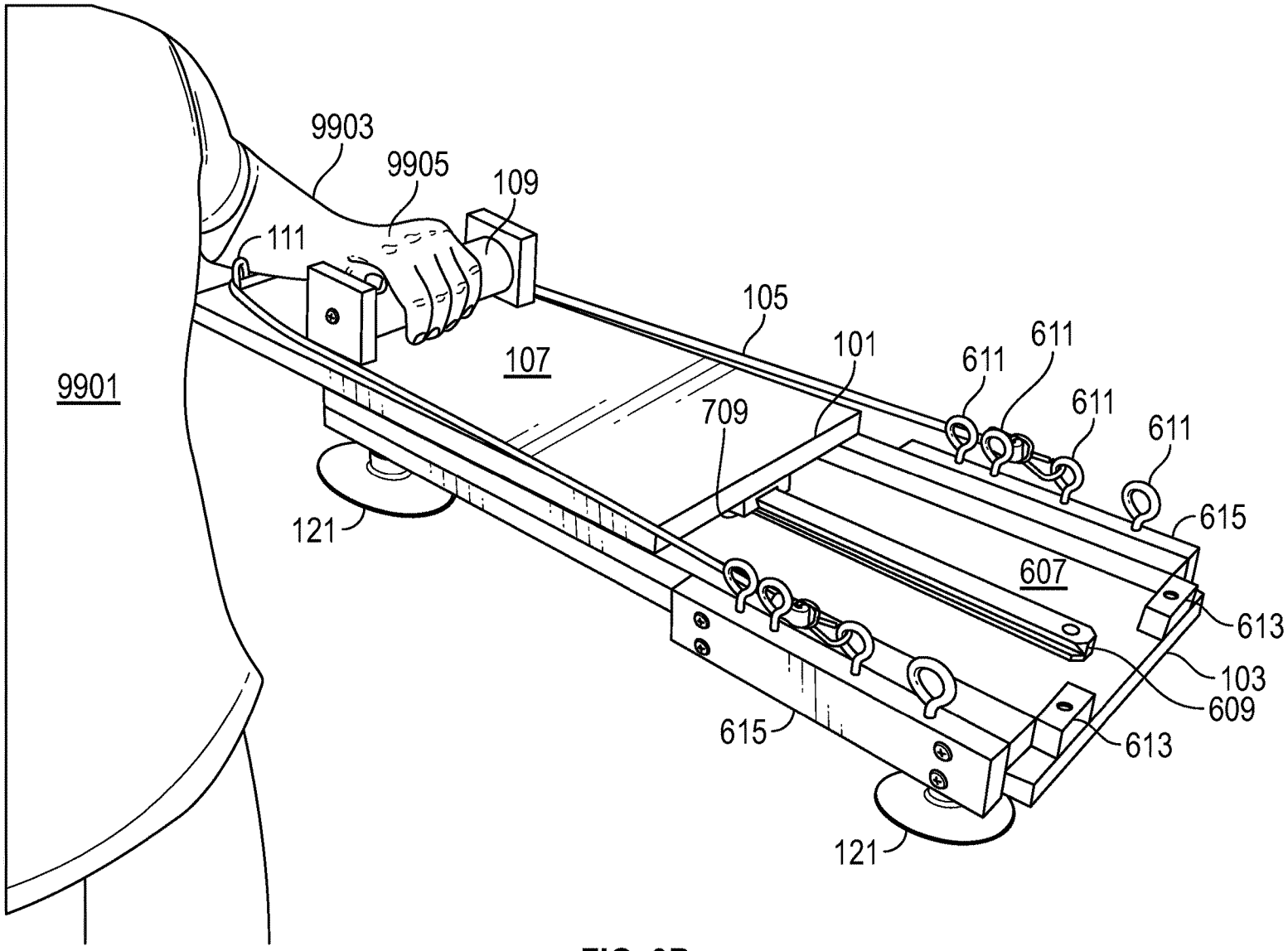
FIG. 3B may show the shoulder exercise machine of FIG. 1A in use, while user may be pulling against a handle, from a different perspective view.
Figure 3C:
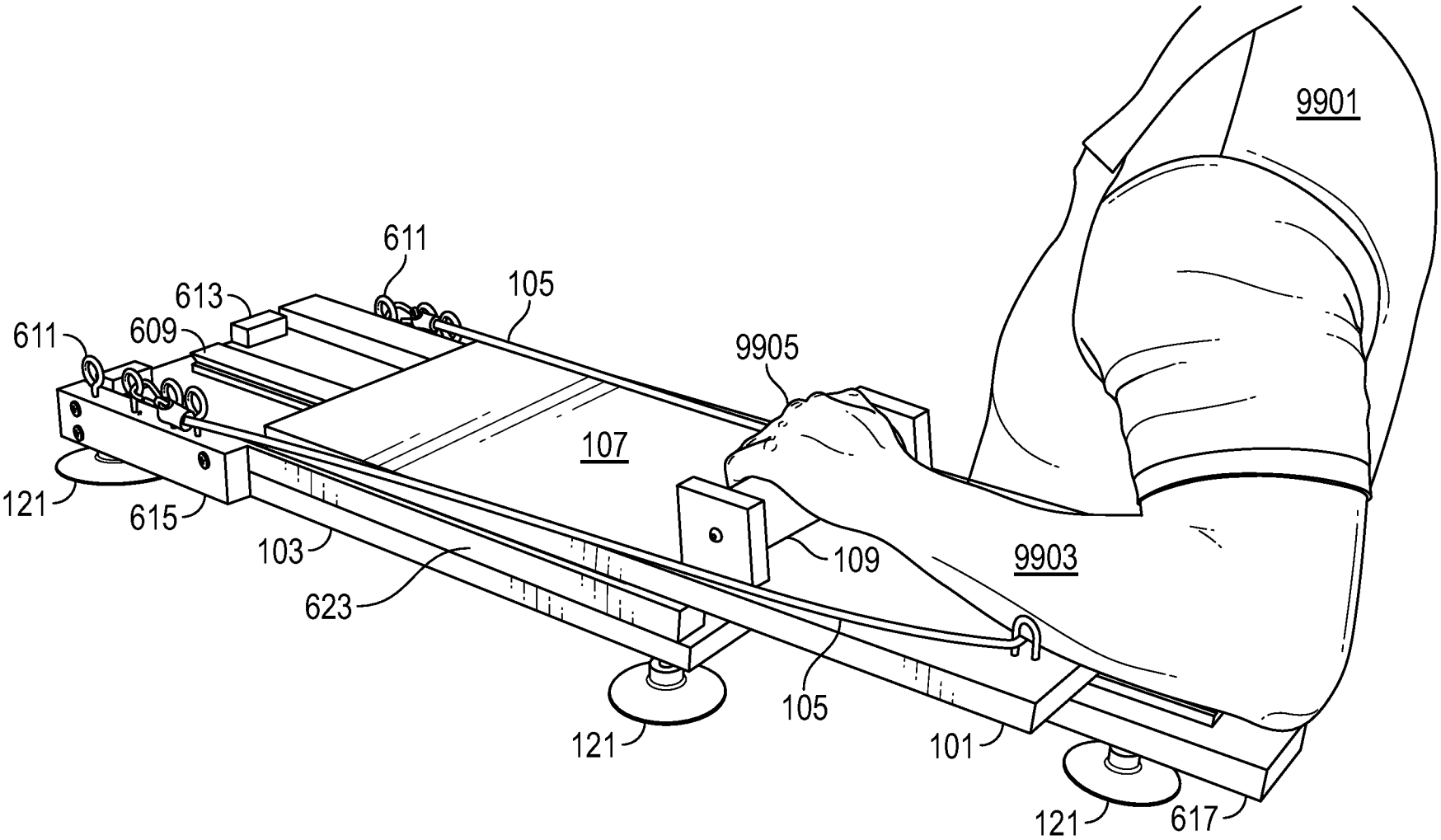
FIG. 3C may show the shoulder exercise machine of FIG. 1A in use, while user may be pulling against a handle, from a perspective view similar to that of FIG. 3A.
Figure 3D:
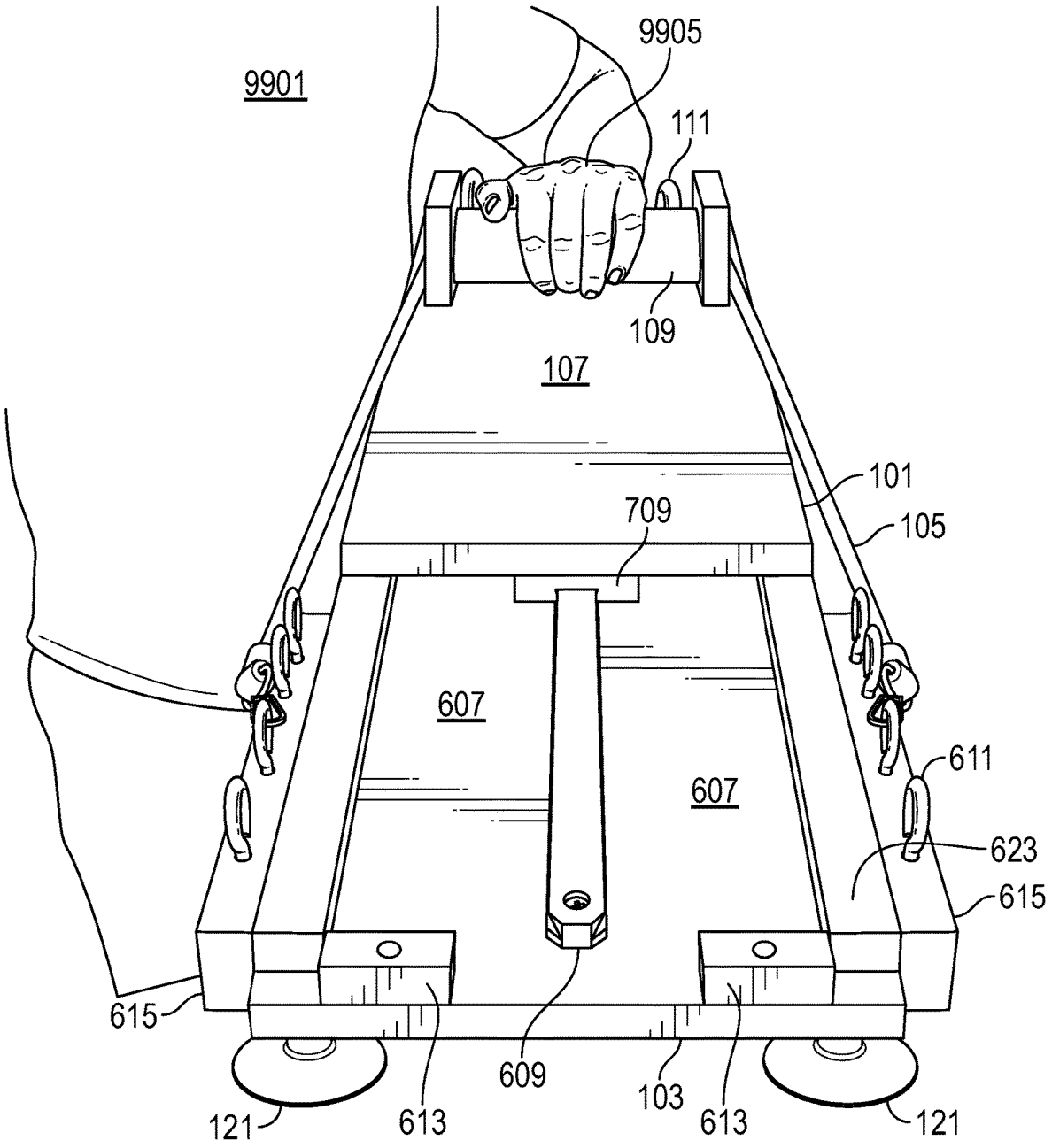
FIG. 3D may show the shoulder exercise machine of FIG. 1A in use, while user may be pulling against a handle, from a rear (back) view.

FIG. 3A may show shoulder exercise machine 100 in use, prior to user 9901 pulling against handle 109, from a perspective view. FIG. 3B may show shoulder exercise machine 100 in use, while user 9901 may be pulling against handle 109, from a different perspective view. FIG. 3C may show shoulder exercise machine 100 in use, while user 9901 may be pulling against handle 109, from a perspective view similar to that of FIG. 3A. FIG. 3D may show shoulder exercise machine 100 in use, while user 9901 may be pulling against handle 109, from a rear (back) view.

In FIG. 3A, user 9901 may not be exerting any pressure on handle 109. Whereas, in FIG. 3B through FIG. 3D, user 9901 may be pulling against handle 109. Such pulling against handle 109 by user 9901, may be pulling against inherent elastic resistance present in resistance member 105; and thus, may result in exercise of the shoulder region, of a single shoulder region, may be achieved. Note, in some embodiments, for such pulling exercising to function, lower member 103 of machine 100 may need to fixed with respect to the supportive substrate that may be supporting machine 100. For example, and without limiting the scope in the present invention, this may be accomplished by feet 121 being suction cups or mounting blocks or clamps that are attached to the supportive substrate.

Note, in the exercises shown in FIG. 3A through FIG. 3D, forearm 9903 may be disposed between two fixed and spaced retainer guides 111 of upper member 101.

Figure 4:
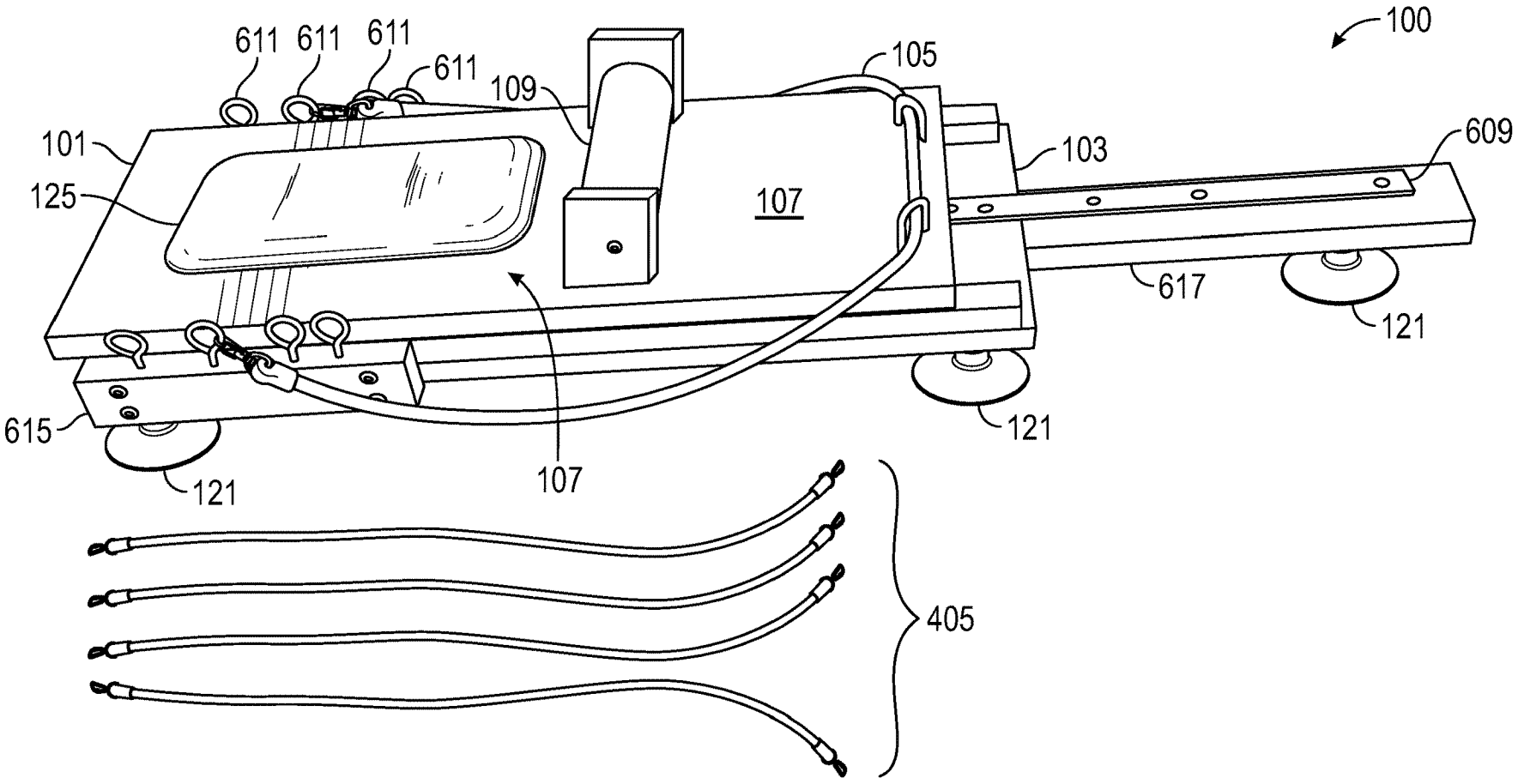
FIG. 4 may show the shoulder exercise machine of FIG. 1A next to a plurality of resistance members, shown from a perspective view.

FIG. 4 may show shoulder exercise machine 100 next to a plurality of resistance members 405, shown from a perspective view. In some embodiments, plurality of resistance members 405 may comprise two or more different resistance members 105. Each such resistance member 105 (selected from plurality of resistance members 405) may have a different predetermined resistance (elasticity) profile. In some embodiments, plurality of resistance members 405 may comprise a predetermined quantity of resistance members 105 each with its own different predetermined resistance (elasticity) profile. Thus user 9901 may select and/or use a given resistance member 105 with a desired resistance (elasticity) profile. In some embodiments, in use, a give machine 100, may then provide very light resistance to moderate resistance, depending which and/or how many resistance members 105 may be removably attached to given machine 100. Alternatively, in some embodiments, user 9901 may removably attach more than one resistance member 105 to machine 100, to increase resistance during exercising.

Figure 5A:
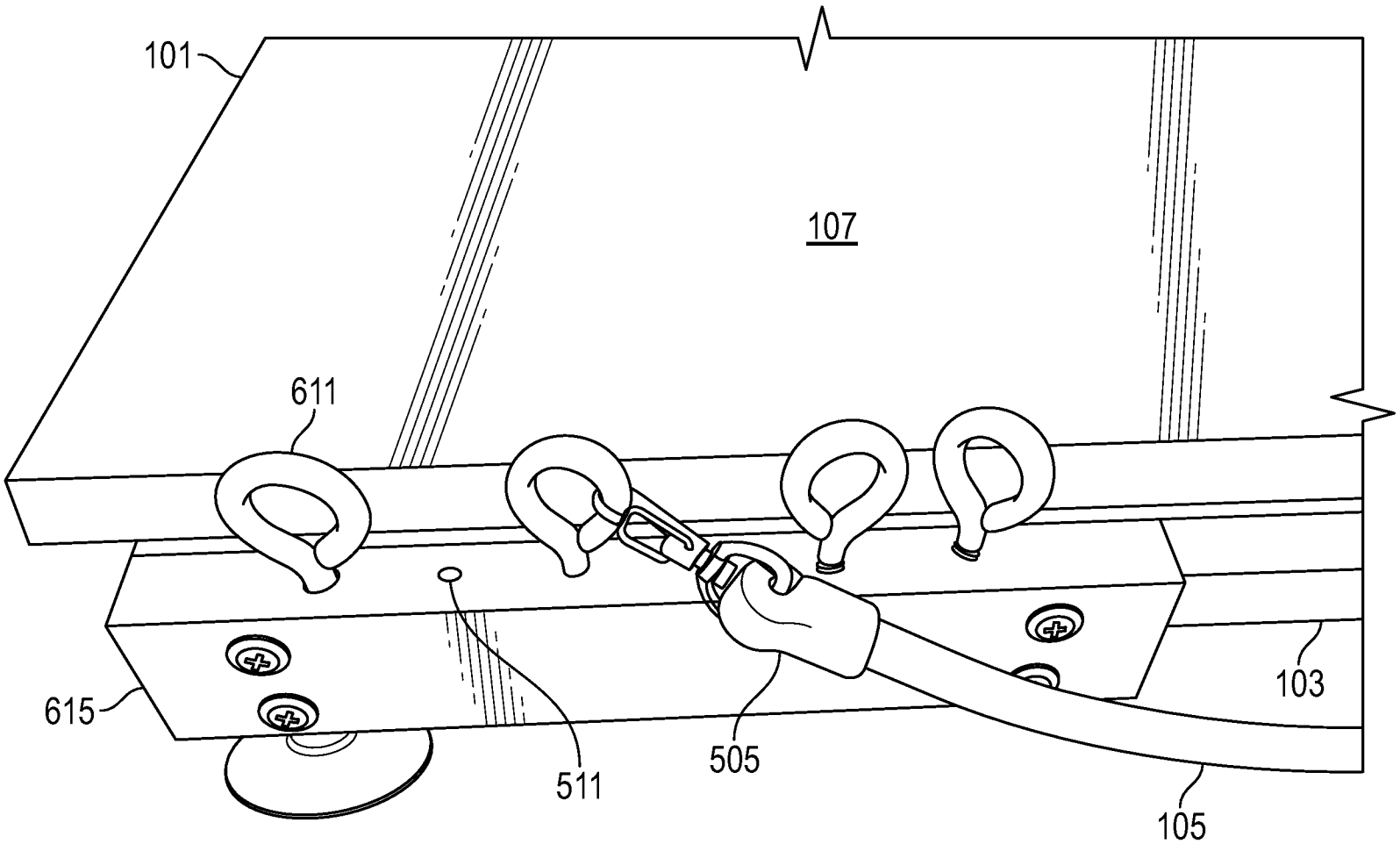
FIG. 5A may show a close up region of the shoulder exercise machine of FIG. 1A showing a terminal end of a resistance member as well as anchors, shown from a perspective view.
Figure 5B:
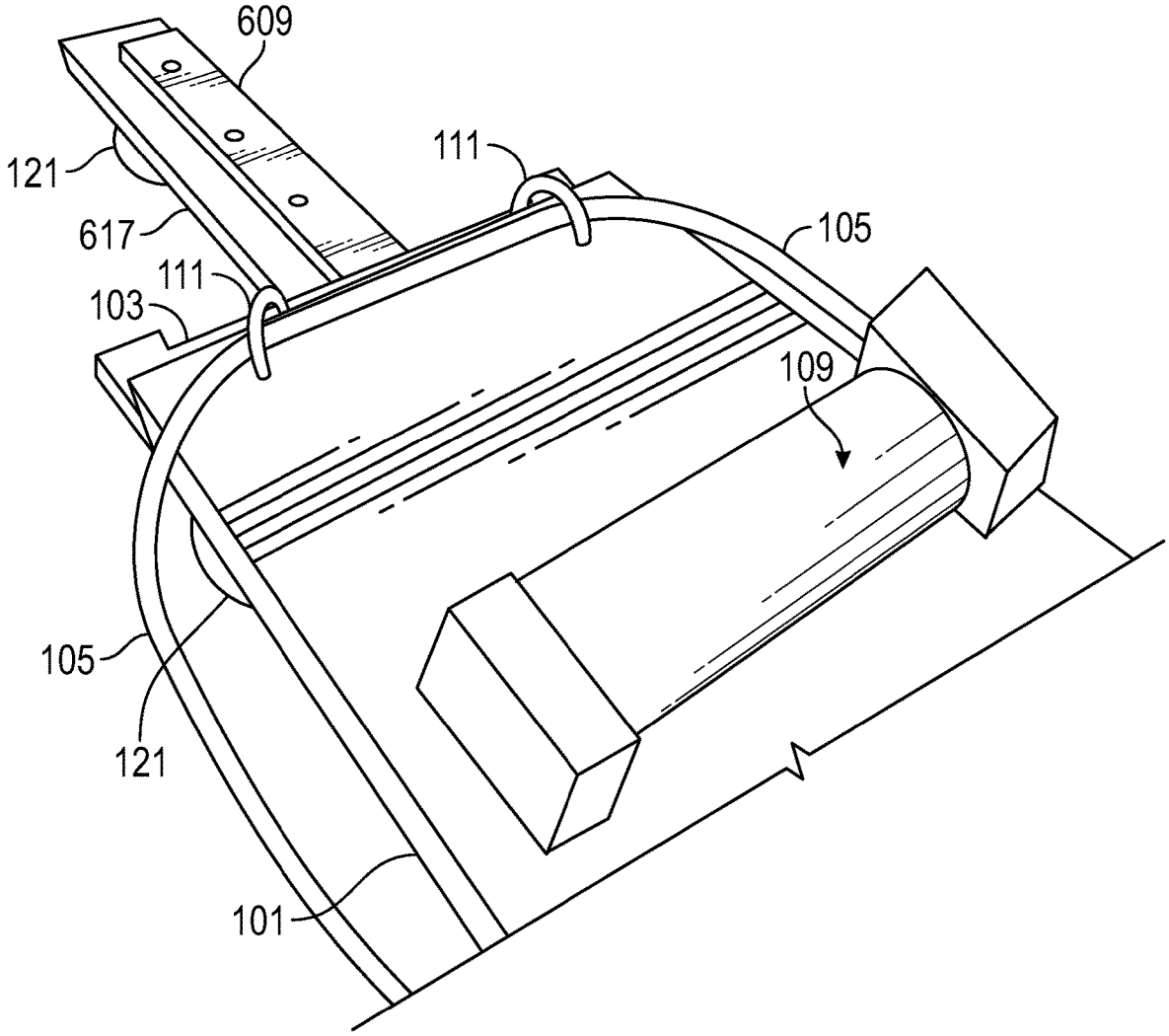
FIG. 5B may show a close up region of the shoulder exercise machine of FIG. 1A showing retainer guides for portions of the resistance member, shown from a perspective view.

FIG. 5A may show a close up region of shoulder exercise machine 100 showing a terminal end 505 of a given resistance member 105, as well as anchors 611, shown from a perspective view. FIG. 5B may show a close up region of shoulder exercise machine 100 showing retainer guides 111 for portions of the resistance member 105, shown from a perspective view. In some embodiments, resistance member 105 may be at least one elongate elastic member with two opposing terminal ends 505. In some embodiments, each of the two opposing terminal ends 505 may removably attach to a given anchor 611 of the lower member 103. In some embodiments, a portion of resistance member 105 may pass through a loop or a ring of at least one retainer guide 111 of upper member 101 such that there may resistance with respect to sliding translation between upper member 101 and the lower member 103. In some embodiments, anchors 611 may be disposed away from at least one retainer guide 111. In some embodiments, a given terminal end 505 may comprise a mechanical fastener. In some embodiments, a given terminal end 505 may comprise a clip, a hook, a carabiner, and/or the like. In some embodiments, the mechanical fastener, the clip, the hook, or the carabiner of terminal end 505 may removably attached to a given anchor 611. See e.g., FIG. 5A, FIG. 5B, and FIG. 1A.

Figure 6A:
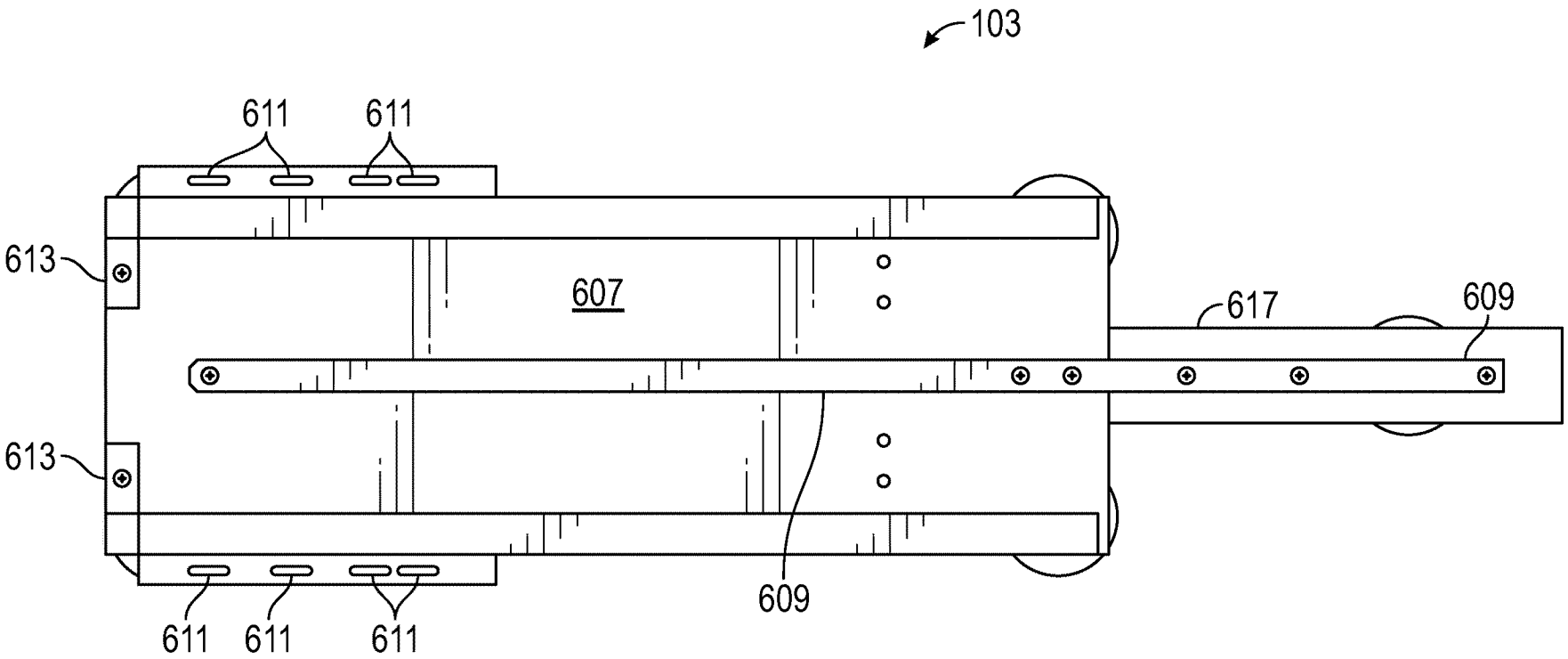
FIG. 6A may show a lower member of the shoulder exercise machine of FIG. 1A, but with an upper member removed, shown from a top view.
Figure 6B:
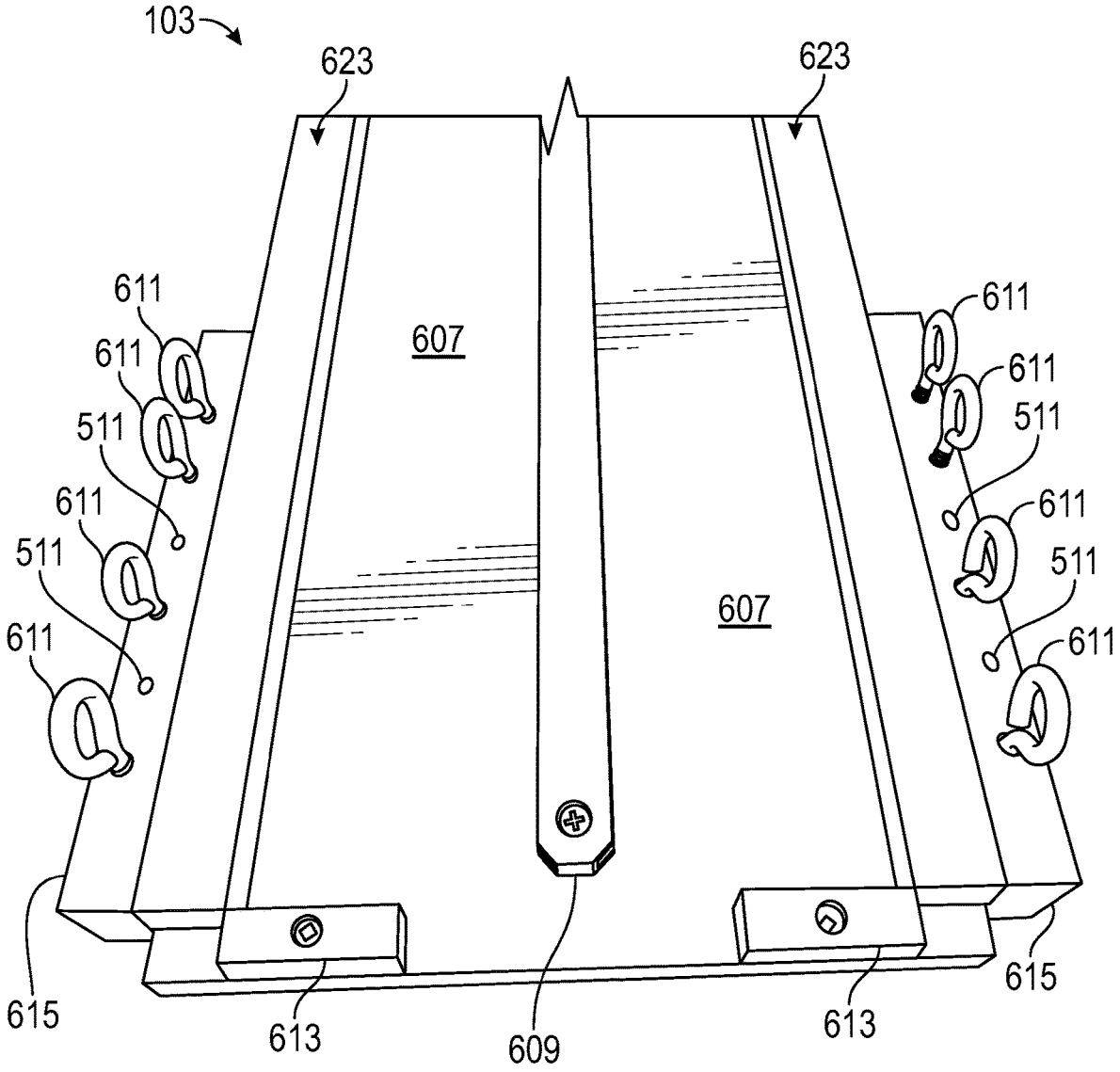
FIG. 6B may show a close up portion of a lower-member-upper-surface of the lower member, shown from a perspective view.

FIG. 6A may show lower member 103 of shoulder exercise machine 100, but with upper member 101 removed (not shown in this view), shown from a top view. FIG. 6B may show a close up portion of lower-member-upper-surface 607 of lower member 103, shown from a perspective view.

In some embodiments, lower member 103 may be rigid to substantially semi-rigid. In some embodiments, lower member 103 (not including anchors 611) may be substantially constructed from one or more of: plastic, metal, and/or wood. In some embodiments, lower member 103 may comprise a lower-member-upper-surface 607 that may be an upper surface of lower member 103. See e.g., FIG. 6A and FIG. 6B.

Figure 7A:
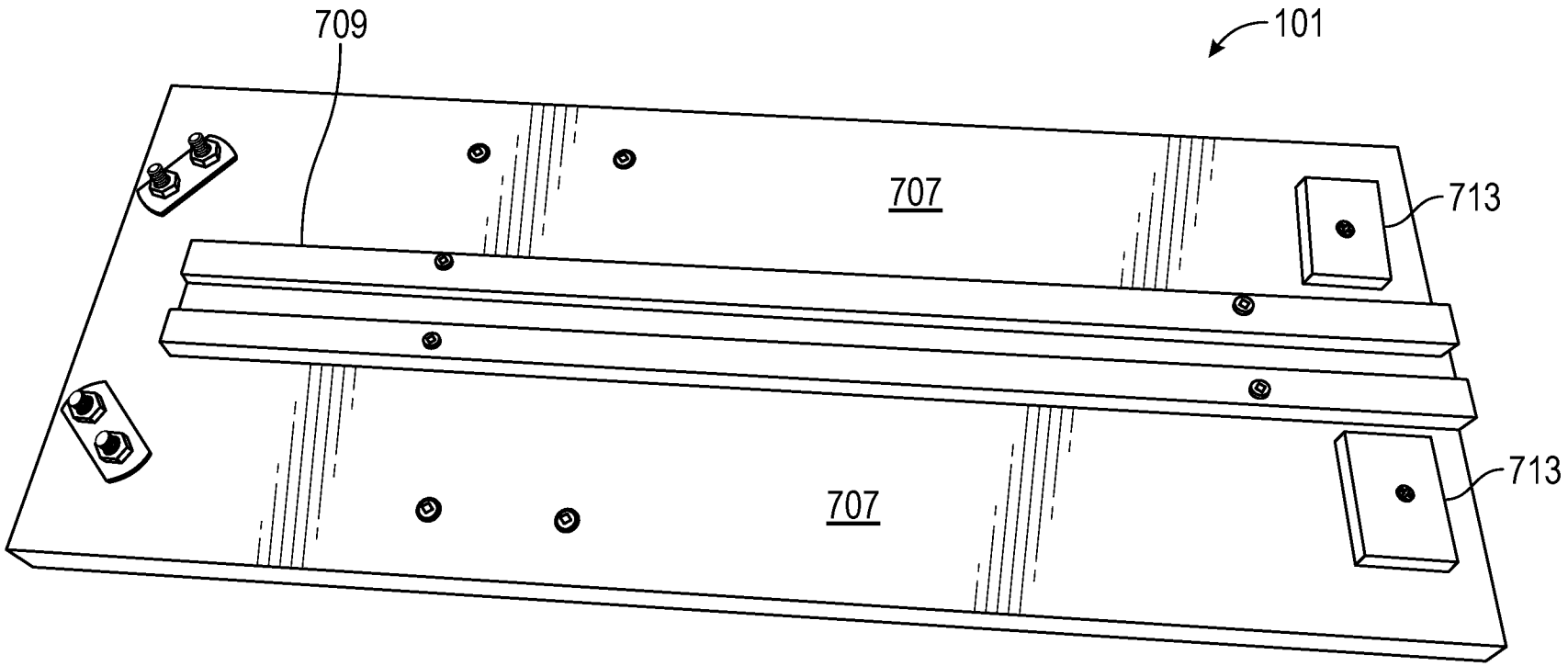
FIG. 7A may show an upper-member-lower-surface of the upper member of the shoulder exercise machine of FIG. 1A, shown from a perspective view.
Figure 7B:
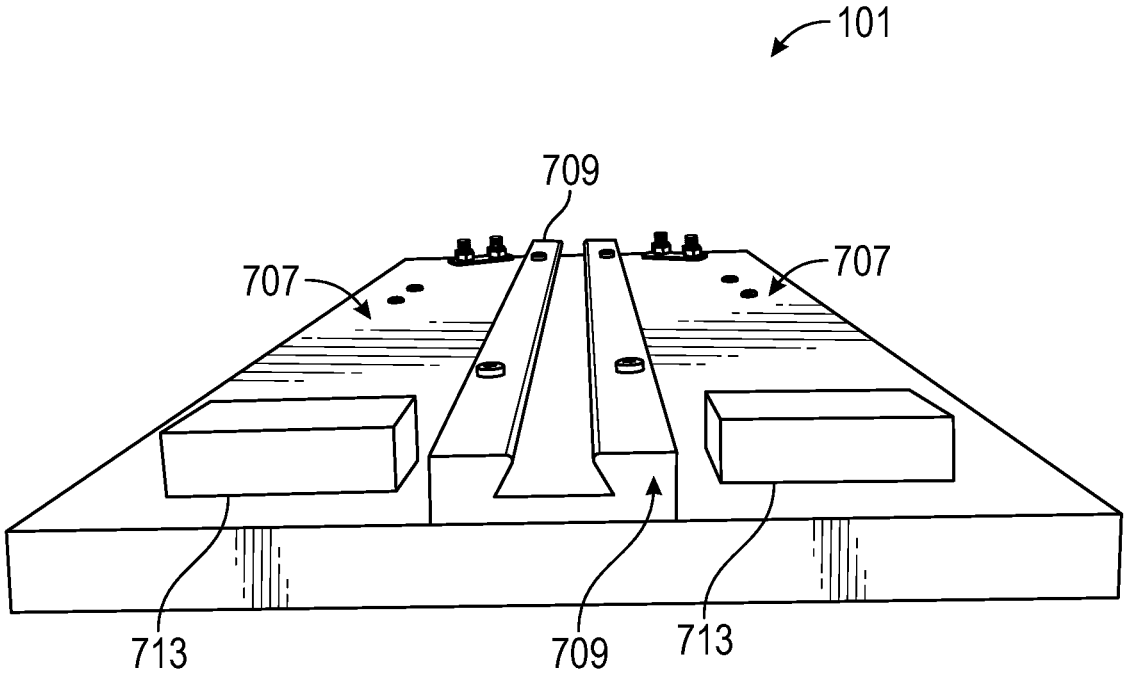
FIG. 7B may show the upper-member-lower-surface of the upper member of the shoulder exercise machine of FIG. 1A, shown from a perspective rear view.

In some embodiments, a portion of lower-member-upper-surface 607 may comprise a second sliding mechanism 609 that may complimentary mate with a first sliding mechanism 709 of upper member 101 (see FIG. 7A and FIG. 7B for first sliding mechanism 709). In some embodiments, first sliding mechanism 709 and second sliding mechanism 609 may be of a rail and rail-receiving-channel relationship. For example, and without limiting the scope of the present invention, in some embodiments, second sliding mechanism 609 may be a rail and first sliding mechanism 709 may be a complimentary rail-receiving-channel. (Whereas in other embodiments, first sliding mechanism 709 may be a rail and second sliding mechanism 609 may be a complimentary rail-receiving-channel.) See e.g., FIG. 6A, FIG. 6B, FIG. 7A, FIG. 7B, FIG. 1E, and FIG. 1F.

In some embodiments, lower member 103 may comprise at least one anchor 611 for anchoring a portion of resistance member 105 to lower member 103. In some embodiments, a given anchor 611 may comprise a loop or a ring structure. In some embodiments, a given anchor 611 may be rigid to substantially rigid. Terminal ends 505 of a given resistance member 105 may removably attached to the at least one anchor 611. See e.g., FIG. 6A, FIG. 6B, and FIG. 1A.

In some embodiments, lower member 103 may comprise at least two anchors 611 for anchoring a portion of resistance member 105 to lower member 103. In some embodiments, these at least two anchors 611 may be disposed opposite of each other, separated by a width of a lower-member-upper-surface 607 that may be an upper surface of lower member 103. Terminal ends 505 of a given resistance member 105 may removably attached to the oppositely disposed anchors 611. See e.g., FIG. 6A, FIG. 6B, FIG. 1A, and FIG. 1B.

In some embodiments, lower member 103 may comprise at least two banks of oppositely disposed anchors 611 for anchoring terminal ends 505 of resistance member 105 to lower member 103. In some embodiments, these at least two banks of oppositely disposed anchors 611 may be disposed opposite of each other, separated by a width of a lower-member-upper-surface 607. In some embodiments, each such bank of anchors 611 may comprise a predetermined quantity of anchors 611, spaced at predetermined locations along a length of lower member 103. Such different spacing along the length of lower member 103 provide another means for varying the resistance associated with a given resistance member 105. That is, anchors 611 spaced further away from retainer guides 111 of upper member 101 will result in greater resistance of the given resistance member 105 removably attached to machine 100. Terminal ends 505 of a given resistance member 105 may removably attached to the oppositely disposed anchors 611 in each such bank of anchors 611. See e.g., FIG. 6A, FIG. 6B, FIG. 1A, and FIG. 1B.

In some embodiments, lower member 103 may comprise a pair of anchor-support-blocks 615 disposed opposite of each other. In some embodiments, each anchor-support-blocks 615 selected from the pair of anchor-support-blocks 615 may be rigid to substantially rigid. In some embodiments, each anchor-support-blocks 615 selected from the pair of anchor-support-blocks 615 may be substantially constructed of plastic, metal, and/or wood. In some embodiments, each anchor-support-blocks 615 selected from the pair of anchor-support-blocks 615 may comprise at least one anchor 611. In some embodiments, each anchor-support-blocks 615 selected from the pair of anchor-support-blocks 615 may comprise a predetermined quantity of anchors 611. In some embodiments, this predetermined quantity of anchors 611 on each anchor-support-block 615 may be equal in quantity. In some embodiments, each of the at least one anchor 611 may be for anchoring a portion of the resistance member 105 to lower member 103, such as the terminal end 505 portion. See e.g., FIG. 6A, FIG. 6B, FIG. 1A, and FIG. 1B.

In some embodiments, on upper surfaces and/or on exterior surfaces of anchor-support-blocks 615 may be lateral extensions of lower member 103, extending on opposite width sides of lower member 103, that provide a location(s) for anchor(s) 611 to attach to lower member 103.

Figure 9:
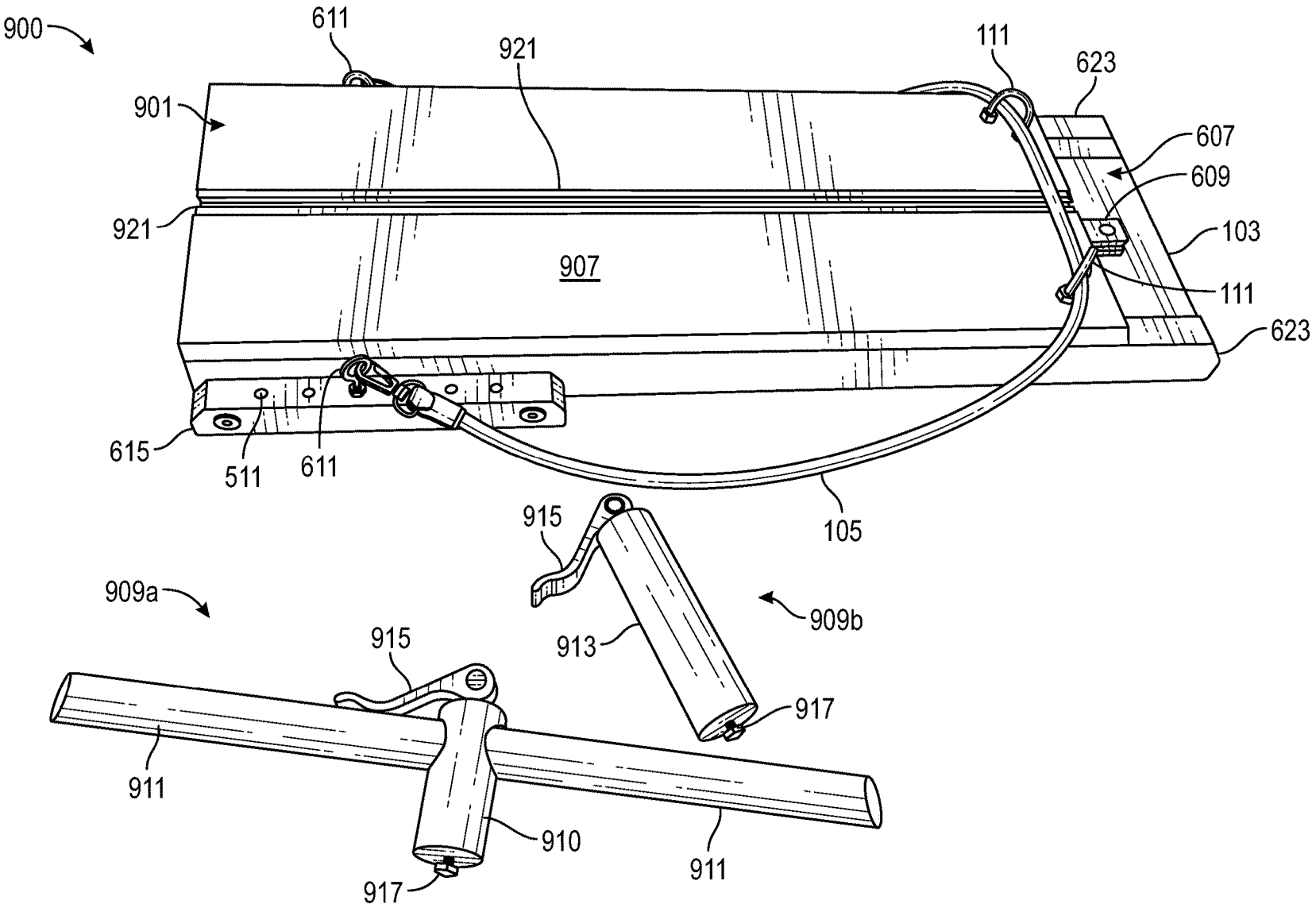
FIG. 9 may show an embodiment of a shoulder exercise machine, along with two different handle types off to a side of the shoulder exercise machine, shown from a top perspective view.

In some embodiments, on upper surfaces and/or on exterior surfaces of anchor-support-blocks 615 may be one or more anchor receiver(s) 511, see e.g., FIG. 5A, FIG. 6B, and/or FIG. 9. In some embodiments, a given anchor receiver 511 may be configured to receive a given anchor 611. In some embodiments, a given anchor receiver 511 may be a hole configured to receive a given anchor 611. In some embodiments, a given anchor receiver 511 may be a threaded hole configured to receive a given anchor 611.

In some embodiments, lower member 103 may comprise at least one stop 613. In some embodiments, a given stop 613 may be rigid to substantially semi-rigid. In some embodiments, a given stop 613 may be substantially constructed of one or more of plastic, metal, and/or wood. In some embodiments, lower-member-upper-surface 607 may comprise at least one stop 613. In some embodiments, there may be two stops 613. In some embodiments, a given stop 613 may assist in preventing sliding translation between upper member 101 and the lower member 103 in one direction, at the location of the given stop 613. In some embodiments, a given stop 613 may be a raised surface with respect to lower-member-upper-surface 607. See e.g., FIG. 6A and FIG. 6B.

In some embodiments, lower member 103 may comprise a neck-region 617 that may be an elongate portion that extends outwards from a main portion of lower member 103. In some embodiments, neck-region 617 may be narrower in width as compared against a width of the main portion of lower member 103. In some embodiments, neck-region 617 may structurally support a portion of second sliding mechanism 609. In some embodiments, neck-region 617 may be rigid to substantially semi-rigid. In some embodiments, neck-region 617 may be substantially constructed from plastic, metal, and/or wood. See e.g., FIG. 6A, FIG. 6B, FIG. 1A, and FIG. 1B.

In some embodiments, lower member 103 may comprise a pair of oppositely disposed supports-for-upper-members 623. In some embodiments, supports-for-upper-members 623 may structurally support upper member 101. In some embodiments, supports-for-upper-members 623 may be raised a predetermined and equal distance above lower-member-upper-surface 607. In some embodiments, supports-for-upper-members 623 may be attached to lower-member-upper-surface 607. In some embodiments, supports-for-upper-members 623 may be rigid to substantially semi-rigid. In some embodiments, supports-for-upper-members 623 may be substantially constructed from plastic, metal, and/or wood. See e.g., FIG. 6A, FIG. 6B, FIG. 1A, and FIG. 1B.

FIG. 7A may show an upper-member-lower-surface 707 of upper member 101 of shoulder exercise machine 100, shown from a perspective view. FIG. 7B may show upper-member-lower-surface 707 of upper member 101 of shoulder exercise machine 100, shown from a perspective rear view.

In some embodiments, upper member 101 may comprise upper-member-lower-surface 707 that may be a lower surface of upper member 101. In some embodiments, a portion of upper-member-lower-surface 707 may comprise first sliding mechanism 709. In some embodiments, first sliding mechanism 709 may complimentary mate with second sliding mechanism 609 of lower member 103. In some embodiments, first sliding mechanism 709 and second sliding mechanism 609 may be of a rail and rail-receiving-channel relationship. For example, and without limiting the scope of the present invention, in some embodiments, second sliding mechanism 609 may be a rail and first sliding mechanism 709 may be a complimentary rail-receiving-channel. (Whereas in other embodiments, first sliding mechanism 709 may be a rail and second sliding mechanism 609 may be a complimentary rail-receiving-channel.) See e.g., FIG. 7A, FIG. 7B, FIG. 6A, FIG. 6B, FIG. 1E, and FIG. 1F.

In some embodiments, upper member 101 may at least one stop 713. In some embodiments, a given stop 713 may be rigid to substantially semi-rigid. In some embodiments, a given stop 713 may be substantially constructed of one or more of plastic, metal, and/or wood. In some embodiments, upper-member-lower-surface 707 may at least one stop 713. In some embodiments, at least one stop 713 may prevent sliding translation between upper member 101 and lower member 103 in one direction at a location of stop 613 located on lower member 103. That is, when stop 713 butts up against stop 613, no further sliding translation between upper member 101 and lower member may occur in the direction that brought stop 713 to butt against stop 613. In some embodiments, a given stop 713 may be a raised surface with respect to upper-member-lower-surface 707. See e.g., FIG. 7A, FIG. 7B, FIG. 6A, FIG. 6B, and FIG. 1F.

Figure 8:
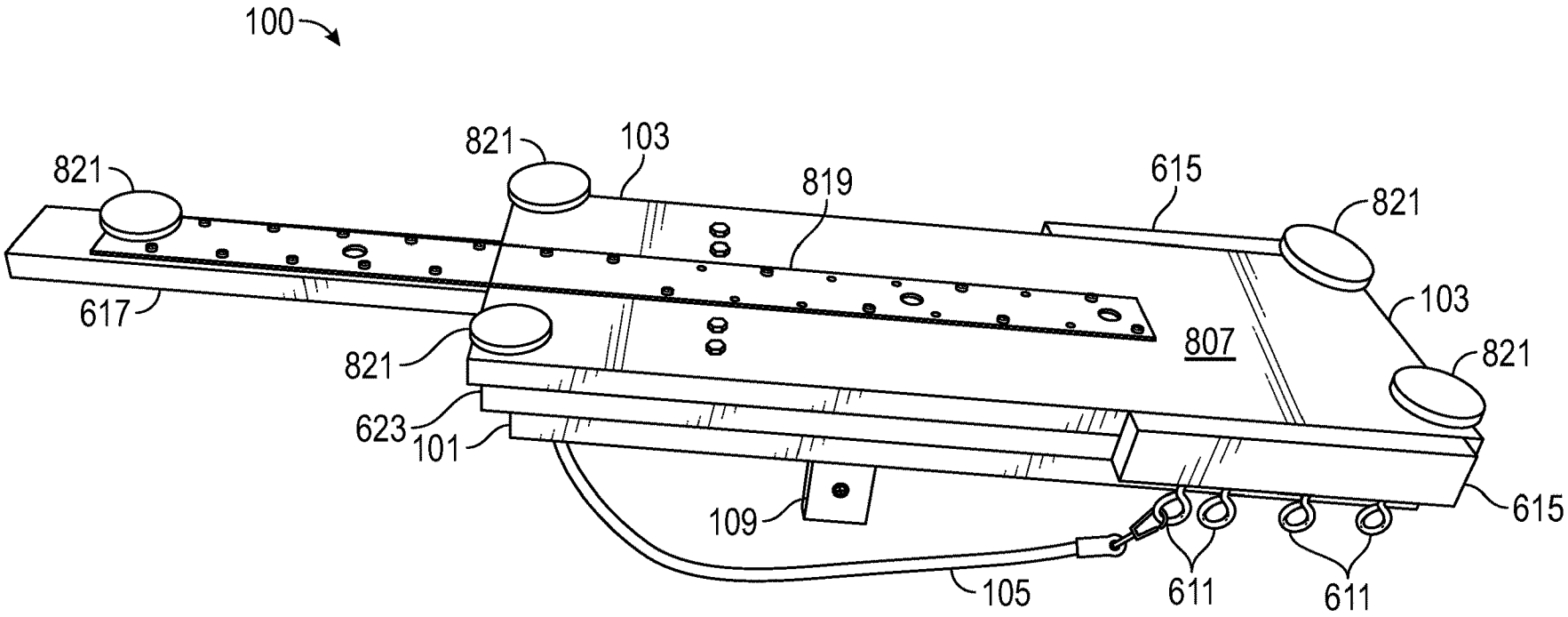
FIG. 8 may show another embodiment of a shoulder exercise machine, shown from a bottom perspective view.

FIG. 8 may show another embodiment of a shoulder exercise machine 100, shown from a bottom perspective view. Shoulder exercise machine 100 shown in FIG. 1G may differ from shoulder exercise machine 100 shown in FIG. 8 by the nature of the feet of the given machine 100. For example, in FIG. 1G, machine 100 may comprise three or more feet 121 which may be suction cups. Whereas, in FIG. 8, machine 100 may comprise three or more feet 821, which may not be suction cups. In some embodiments, lower member 103 may comprise lower-member-lower-surface 807; wherein lower-member-lower-surface 807 may comprise at least three feet 821. In some embodiments, feet 821 may comprise non-slip and/or non-skid properties. In some embodiments, feet 821 may be clamps and/or mounting blocks.

FIG. 9 may show an embodiment of a shoulder exercise machine 900, along with two different handle types (handle 909*a* and handle 909*b*) off to a side of the shoulder exercise machine 900, shown from a top perspective view. In some embodiments, shoulder exercise machine 900 may be substantially similar to shoulder exercise machine 100, except upper member 101 of shoulder exercise machine 100 may be replaced with upper member 901 in shoulder exercise machine 900. For example, and without limiting the scope of the present invention, in terms of similarities, upper member 901 may be slidingly attached to lower member 103 in a same manner as upper member 101 is slidingly attached to lower member 103 with respect to shoulder exercise machine 100. In some embodiments, lower member 103 of shoulder exercise machine 900 may or may not have an extended elongate neck region that shoulder exercise machine 100 may have (compare for example FIG. 9 to FIG. 1A).

Continuing discussing FIG. 9, in some embodiments, upper member 901 may be substantially similar to upper member 101, except upper member 901 may comprise a channel 921 on upper-member-upper-surface 907. In some embodiments, upper-member-upper-surface 907 may be substantially similar to upper-member-upper-surface 107, except upper-member-upper-surface 907 may comprise a channel 921. In some embodiments, upper member 901 may comprise upper-member-upper-surface 907. In some embodiments, upper-member-upper-surface 907 may be an upper surface of upper member 901.

Continuing discussing FIG. 9, in some embodiments, upper-member-upper-surface 907 may comprise at least one channel 921. In some embodiments, at least one channel 921 may be located on top of upper-member 901. In some embodiments, at least one channel 921 may be located on top of upper-member-upper-surface 907. In some embodiments, channel 921 may be configured to receive at least some portion of a handle, such as, but not limited to, handle 909*a* and/or handle 909*b*. In some embodiments, channel 921 may be a receiving channel and/or a receiving slot. In some embodiments, channel 921 may be substantially linear and/or straight. In some embodiments, channel 921 may have at least one curved portion. In some embodiments, channel 921 may run from one end of upper member 901 to an opposite end of upper member 901. In some embodiments, channel 921 may be accessed from either end of upper member 901. In some embodiments, different types, styles, and/or quantities of handles may be attached to a given channel 921. In some embodiments, attachment of a given handle to a given handle 921 may be removable attachment.

Continuing discussing FIG. 9, in some embodiments, at least some portion of a handle (e.g., handle 909*a* and/or handle 909*b*) may be received into channel 921. In some embodiments, handle 909*a* may be configured to be gripped by one or two hand(s) 9905 of user 9901, see e.g., FIG. 14A, FIG. 14B, FIG. 17A, FIG. 17B, FIG. 19A, and/or FIG. 19B. In some embodiments, handle 909*a* may be configured to be gripped by one or two hand(s) 9905 of user 9901 and wherein the portion(s) of handle 909*a* that are intended to be gripped by hand(s) 9905 of the user 9901, are in a horizontal orientation with respect to shoulder exercise machine 900, see e.g., FIG. 14A, FIG. 14B, FIG. 17A, FIG. 17B, FIG. 19A, and/or FIG. 19B. Continuing discussing FIG. 9, in some embodiments, handle 909*a* may comprise two horizontal handles 911, a lever 915, and a friction knob 917—all disposed around a central vertical member 910. In some embodiments, the two horizontal handles 911 may be disposed opposite from the central vertical member 910, i.e., extending in opposite directions away from each other with central vertical member 910 disposed in a middle between the two horizontal handles 911. In some embodiments, lever 915 may be disposed on a top of central vertical member 910. In some embodiments, friction knob 917 may be disposed on a bottom of central vertical member 910. In some embodiments, lever 915 may be disposed opposite of friction knob 917. In some embodiments, lever 915 may be disposed opposite of friction knob 917 with central vertical member 910 disposed in a middle between lever 915 and friction knob 917. In some embodiments, lever 915 may be operatively and physically linked to friction knob 917. In some embodiments, friction knob 917 may be comprised of a centralized elongate member that extends from the bottom of central vertical member 910 and that distally terminates into a flange, wherein a diameter of terminal/distal flange is greater than a diameter of the centralized elongate member. In some embodiments, a cross-section of friction knob 917 may be substantially "T" shaped. In some embodiments, at least some portion of friction knob 917 may be configured to be received into channel 921. In some embodiments, when lever 915 may be loose and/or not tightened, friction knob 917 may slide within channel 921. In some embodiments, when lever 915 may be tightened, friction knob 917 may not slide within channel 921. In some embodiments, when lever 915 may be tightened, friction knob 917 may be fixed within channel 921. In some embodiments, when lever 915 may be tightened, friction knob 917 may be non-movable with respect to channel 921. Thus, by loosening lever 915, handle 909*a* may be moved into different positions along a length of channel 921 and then secured/fixed in place by tightening lever 915 when a desired location is reached. In some embodiments, when handle 909*a* may be attached to channel 921, a length of the two horizontal handles 911 may be substantially parallel with a main/major top/upper surface of upper member 901.

Figure 18A:
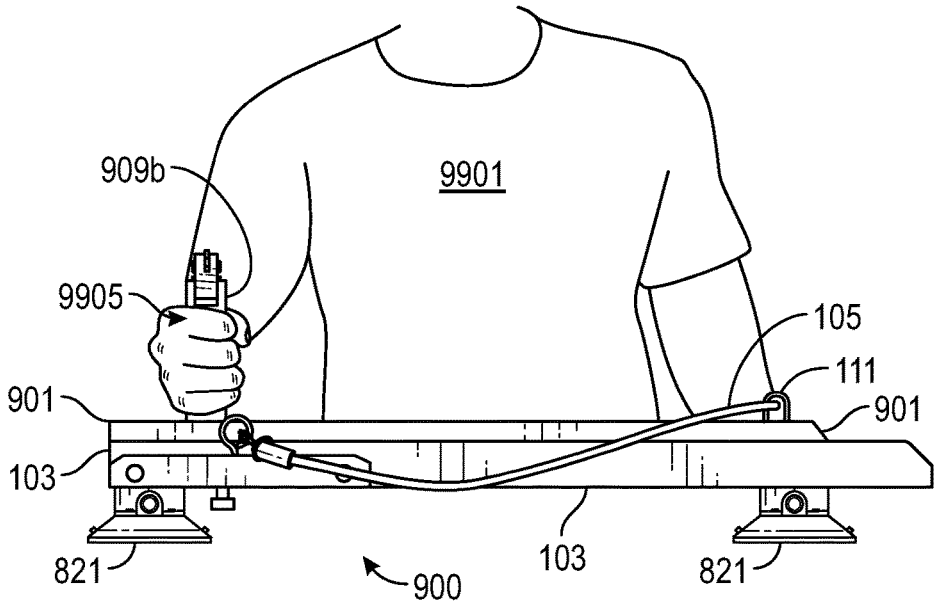
FIG. 18A may show the shoulder exercise machine of FIG. 9, shown from a side view, in use by a user, with no tension on the resistance member.
Figure 18B:
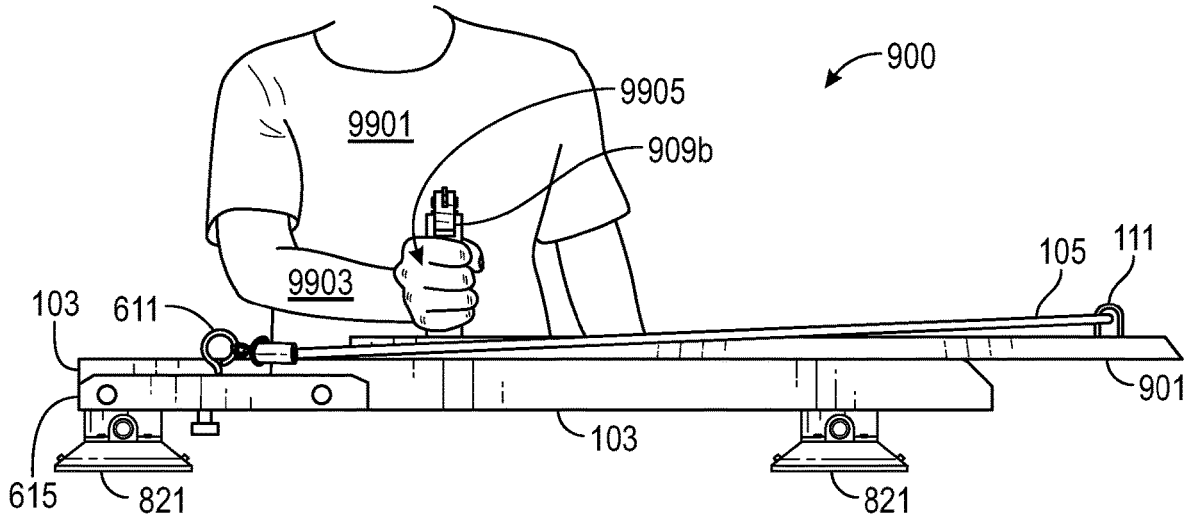
FIG. 18B may show the shoulder exercise machine of FIG. 9, shown from a side view, in use by the user, with at least some tension on the resistance member.

Continuing discussing FIG. 9, in some embodiments, handle 909*b* may be configured to be gripped by at one hand 9905 of user 9901, see e.g., FIG. 15A, FIG. 15B, FIG. 16A, FIG. 16B, FIG. 18A, and/or FIG. 18B. In some embodiments, handle 909*b* may be configured to be gripped by at least one hand 9905 of user 9901 and wherein vertical handle 913 is intended to be gripped by the at least one hand 9905 of the user 9901 in a vertical orientation with respect to shoulder exercise machine 900, see e.g., FIG. 15A, FIG. 15B, FIG. 16A, FIG. 16B, FIG. 18A, and/or FIG. 18B. Continuing discussing FIG. 9, in some embodiments, handle 909*b* may comprise one vertical handle 913, a lever 915, and a friction knob 917. In some embodiments, with respect to handle 909*b*, vertical handle 913 may be take the place of central vertical member 910 of handle 909*a*; although, a difference between vertical handle 913 and central vertical member 910, may be that vertical handle 913 has no horizontal handles 911. In some embodiments, lever 915 may be disposed on a top of vertical handle 913. In some embodiments, friction knob 917 may be disposed on a bottom of vertical handle 913. In some embodiments, lever 915 may be disposed opposite of friction knob 917. In some embodiments, lever 915 may be disposed opposite of friction knob 917 with vertical handle 913 disposed in a middle between lever 915 and friction knob 917. In some embodiments, lever 915 may be operatively and physically linked to friction knob 917. In some embodiments, friction knob 917 may be comprised of a centralized elongate member that extends from the bottom of vertical handle 913 and that distally terminates into a flange, wherein a diameter of terminal/distal flange is greater than a diameter of the centralized elongate member. In some embodiments, a cross-section of friction knob 917 may be substantially "T" shaped. In some embodiments, at least some portion of friction knob 917 may be configured to be received into channel 921. In some embodiments, when lever 915 may be loose and/or not tightened, friction knob 917 may slide within channel 921. In some embodiments, when lever 915 may be tightened, friction knob 917 may not slide within channel 921. In some embodiments, when lever 915 may be tightened, friction knob 917 may be fixed within channel 921. In some embodiments, when lever 915 may be tightened, friction knob 917 may be non-movable with respect to channel 921. Thus, by loosening lever 915, handle 909*a* may be moved into different positions along a length of channel 921 and then secured/fixed in place by tightening lever 915 when a desired location is reached. In some embodiments, when handle 909*b* may be attached to channel 921, a length of vertical handles 913 may be substantially orthogonal (perpendicular) with a main/major top/upper surface of upper member 901.

Continuing discussing FIG. 9, in some embodiments, at least some portion (e.g., friction knob(s) 917) of different handles (e.g., handle 909*a* and/or handle 909*b*) may be inserted into channel 921 at an opening to channel 921 at either end of upper member 901.

Continuing discussing FIG. 9, as in upper member 101, upper member 901 may comprise at least one retainer guide 111 for slidingly retaining/guiding at least a portion of resistance member 105; which in turn may allow for resistance between upper member 901 and lower member 103. For example, and without limiting the scope of the present invention, FIG. 9 may show upper member 901 with two retainer guides 111, both towards one end of upper-member-upper-surface 907, towards opposite corners of that one end of upper-member-upper-surface 907.

Figure 10:
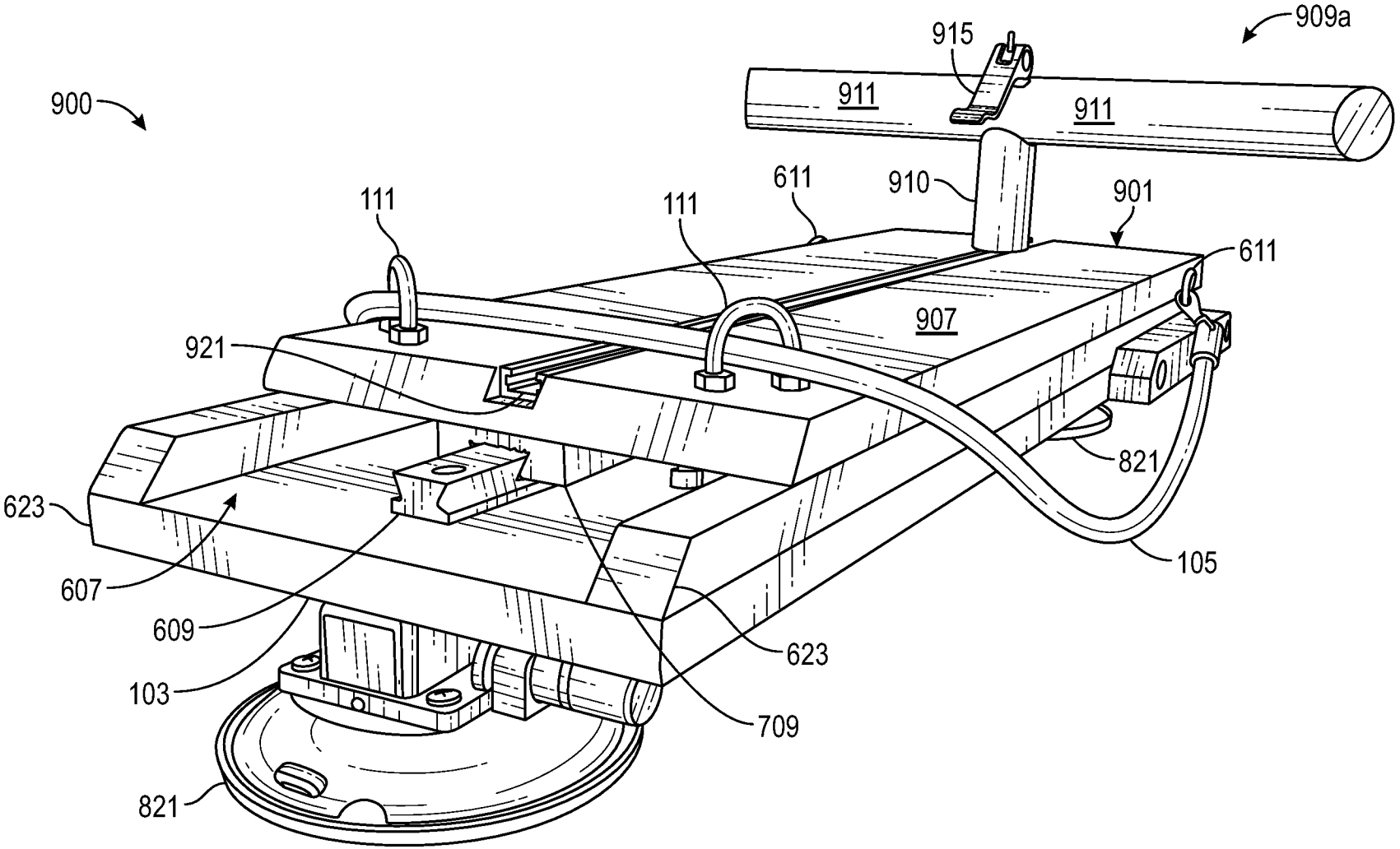
FIG. 10 may show the FIG. 9 embodiment of the shoulder exercise machine from a front perspective view, with one of the handles attached and towards a back of the shoulder exercise machine.

FIG. 10 may show shoulder exercise machine 900 from a front perspective view, with handle 909*a* removably attached and towards a back of shoulder exercise machine 900. In some embodiments, a front of shoulder exercise machine 900 may be a side/end of shoulder exercise machine 900 with retainer guide(s) 111; whereas, a back of shoulder exercise machine 900 may be a side/end of shoulder exercise machine 900 with anchor(s) 611. In some embodiments, a front of shoulder exercise machine 900 may be a side/end of upper member 901 with retainer guide(s) 111; whereas, a back of shoulder exercise machine 900 may be a side/end of lower member 103 with anchor(s) 611. In FIG. 10, a friction knob 917 of handle 909*a* may be retained within channel 921. In some embodiments, a cross-section of channel 921 may be substantially "T" shaped. FIG. 10 may show upper member 901 sliding attached to lower member 103. In some embodiments, a lower surface of upper member 901 may comprise first sliding mechanism 709. In some embodiments, first sliding mechanism 709 may slidingly attach to second sliding mechanism 609 of lower member 103. In some embodiments, first sliding mechanism 709 and second sliding mechanism 609 may have a complimentary geometries (e.g., rail and receiving channel relationship) configured to permit sliding translation between first sliding mechanism 709 and second sliding mechanism 609 (i.e., between upper member 901 and lower member 103). As shown in FIG. 10, the lengths of horizontal handles 911 (of handle 909*a*) may be running in a direction that is substantially perpendicular (orthogonal) to a direction of channel 921; however, lever 915 could be loosened and handle 909*a* could then be rotated so that the lengths of horizontal handles 911 are in some other orientation with respect to the direction channel 921 runs (all while friction knob 917 is retained within channel 921); see e.g., FIG. 19A and FIG. 19B, wherein the lengths of horizontal handles 911 may be substantially parallel with the overall length of shoulder exercise machine 900.

Figure 11:
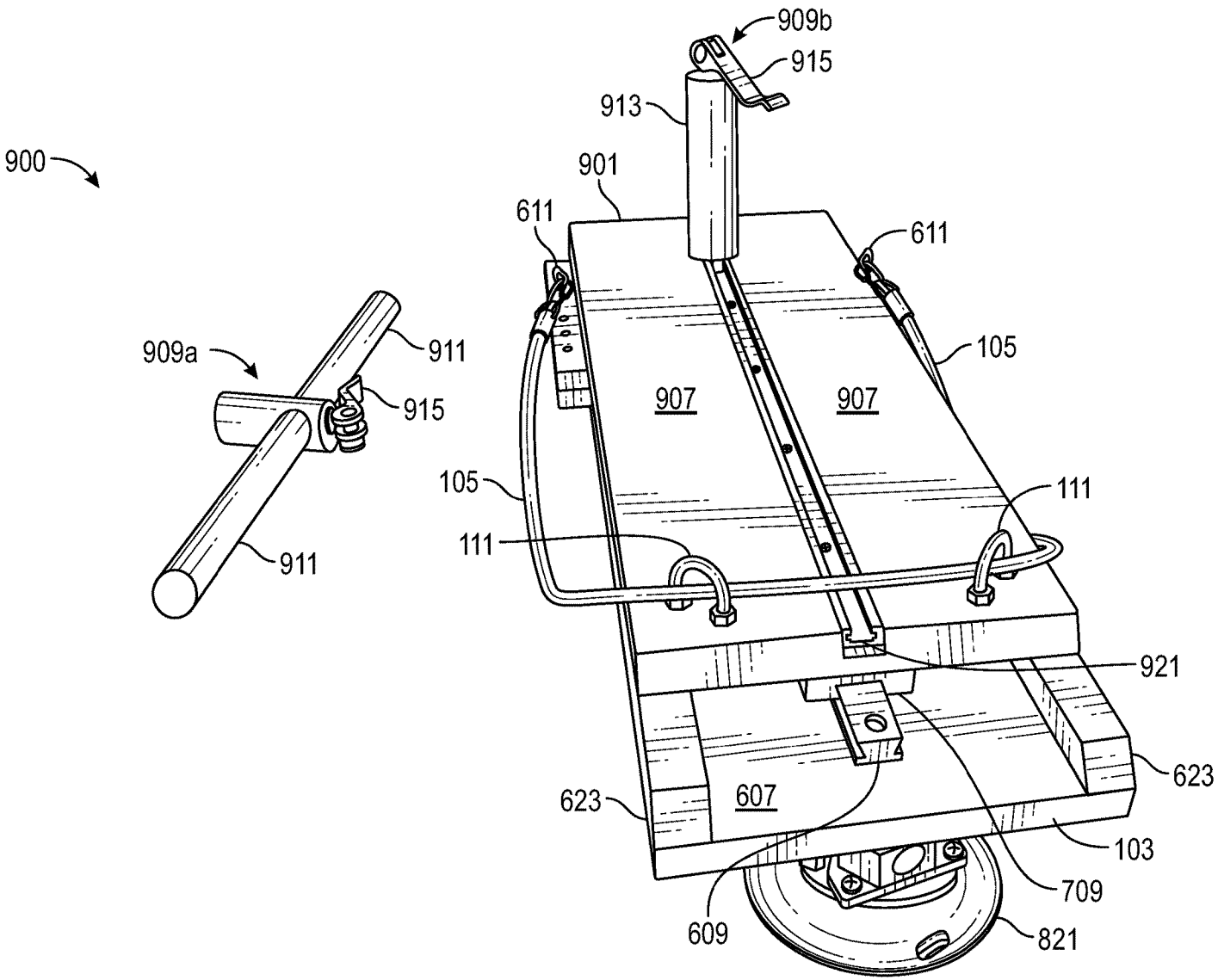
FIG. 11 may show the FIG. 9 embodiment of the shoulder exercise machine from another front perspective view, with one of the handles attached and towards the back of the shoulder exercise machine, and a second handle off to the side of the shoulder exercise machine.

FIG. 11 may show shoulder exercise machine 900 from another front perspective view, with handle 909*b* (removably) attached and towards the back of shoulder exercise machine 900, and with handle 909*a* shown off to the side and detached from shoulder exercise machine 900. In some embodiments, a cross-section of channel 921 may be substantially "T" shaped. In some embodiments, friction knob 917 of handle 909*b* may be retained within channel 921.

Figure 12:
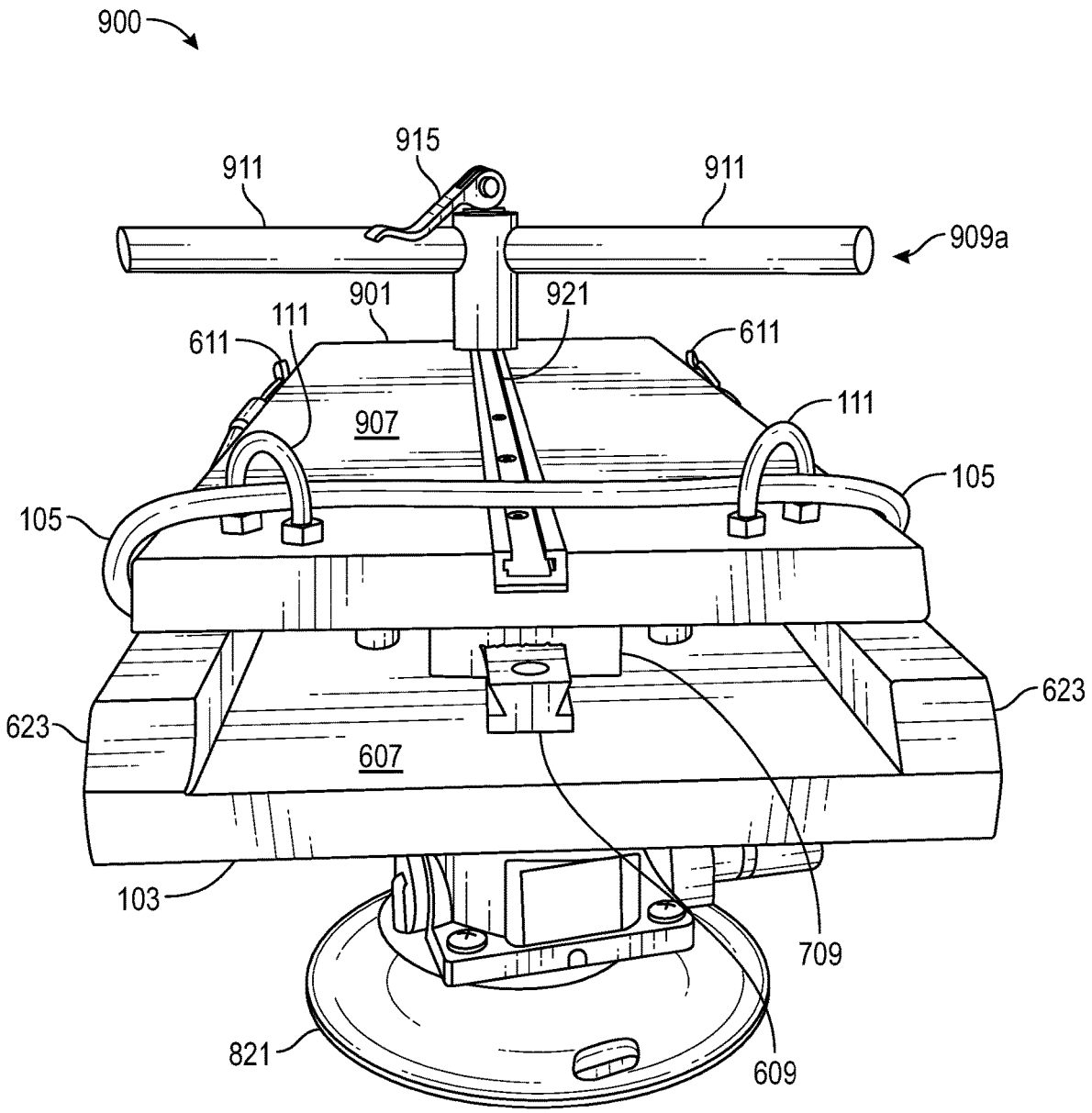
FIG. 12 may show the FIG. 9 embodiment of the shoulder exercise machine from another front perspective view, with one of the handles attached and towards the back of the shoulder exercise machine.

FIG. 12 may show shoulder exercise machine 900 from yet another front perspective view, with handle 909*a* (removably) attached and towards the back of the shoulder exercise machine 900. In some embodiments, a cross-section of channel 921 may be substantially "T" shaped. In some embodiments, friction knob 917 of handle 909*a* may be retained within channel 921.

Figure 13:
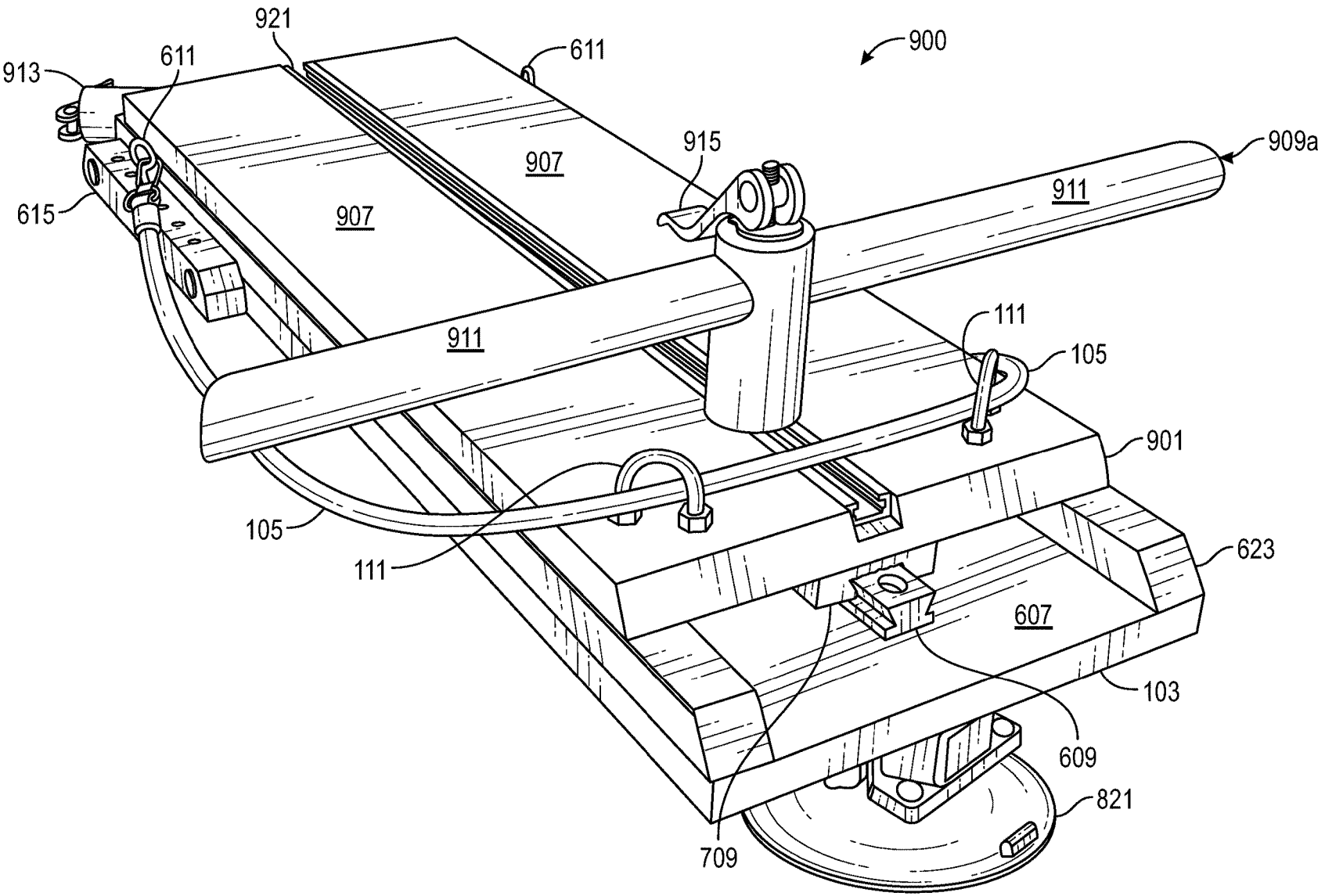
FIG. 13 may show the FIG. 9 embodiment of the shoulder exercise machine from another front perspective view, with one of the handles attached and towards the front (not the back) of the shoulder exercise machine.

FIG. 13 may show shoulder exercise machine 900 from yet still another front perspective view, but now with handle 909*a* (removably) attached and towards the front (not the back) of shoulder exercise machine 900. In some embodiments, a cross-section of channel 921 may be substantially "T" shaped. In some embodiments, friction knob 917 of handle 909*a* may be retained within channel 921. In some embodiments, by loosening lever 915, handles may be slid into different positions along channel 921; and then by tightening lever 915, fixing the handle to that given desired position along channel 921. For example, and without limiting the scope of the present invention, compare FIG. 13 to FIG. 12.

Figure 14A:
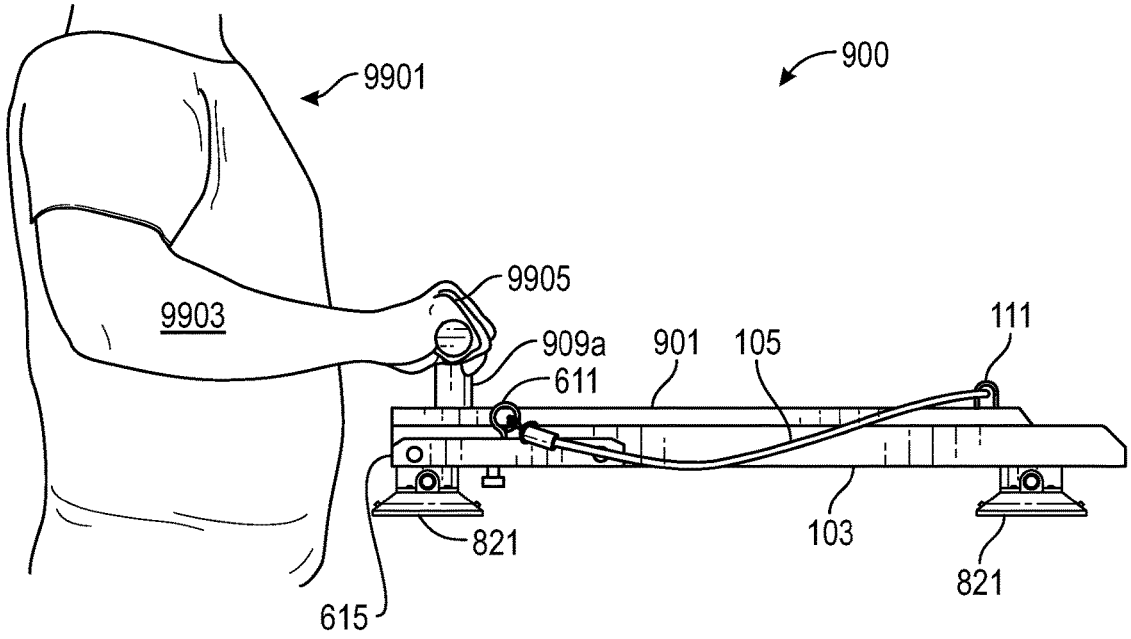
FIG. 14A may show the shoulder exercise machine of FIG. 9, shown from a side view, in use by a user, with no tension on the resistance member.
Figure 14B:
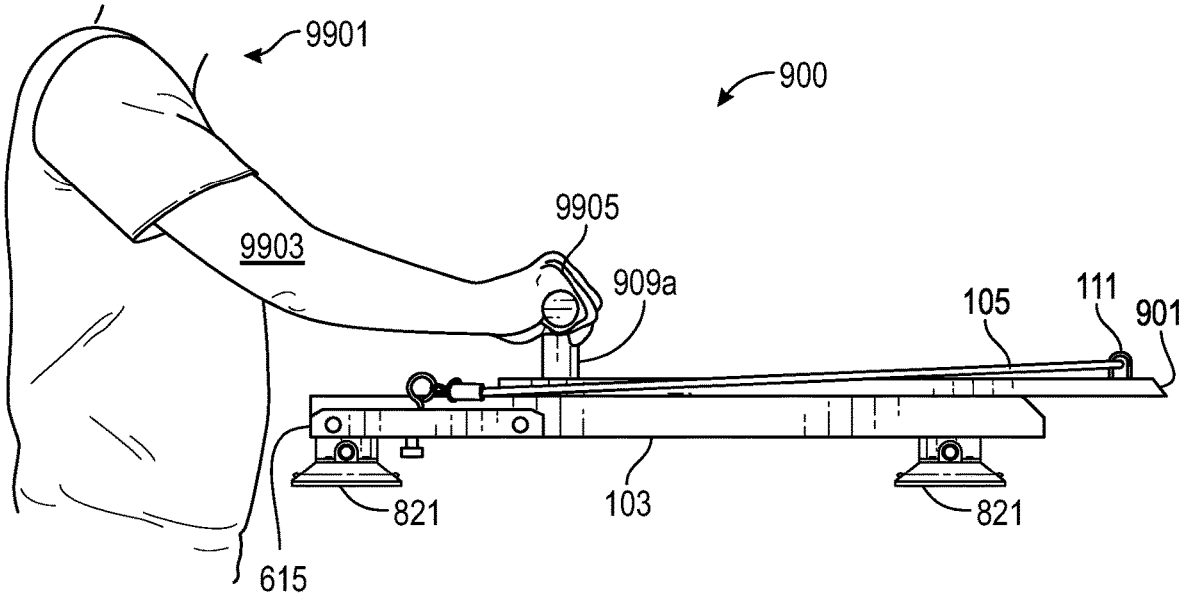
FIG. 14B may show the shoulder exercise machine of FIG. 9, shown from a side view, in use by the user, with at least some tension on the resistance member.

FIG. 14A may show shoulder exercise machine 900, shown from a side view, in use by user 9901, with no tension on the resistance member 105. FIG. 14B may show shoulder exercise machine 900, shown from a side view, in use by user 9901, with at least some tension on the resistance member 105. In FIG. 14A and in FIG. 14B, shoulder exercise machine 900 may be resting upon a table top or the like. In FIG. 14A and in FIG. 14B, shoulder exercise machine 900 may be (removably) fixed/attached to the table top or the like (e.g., by use of suction cups 821). In FIG. 14A and in FIG. 14B, a torso/chest/stomach region of user 9901 may be facing (and/or proximate/close to/next to/adjacent to) shoulder exercise machine 900. In FIG. 14A and in FIG. 14B, an overall length of shoulder exercise machine 900 may be facing and/or extending away from a torso/chest/stomach region of user 9901. In FIG. 14A and in FIG. 14B, the back of shoulder exercise machine 900 may be closest to the stomach region of user 9901. In FIG. 14A and in FIG. 14B, the front of shoulder exercise machine 900 may be disposed (extended) away from the stomach region of user 9901. In FIG. 14A and in FIG. 14B, both hands 9905 of user 9901 may be gripping horizontal handles 911 of handle 909*a*. In FIG. 14A and in FIG. 14B, for user 9901 to exercise using shoulder exercise machine 900, user 9901 uses both hands 9905 to grip handle 909*a* and to then push upper member 901 away from user 9901 (away from lower member 103), which in turn may be cause resistance member 105 to exert resistance to muscles of user 9901, because this motion stretches resistance member 105.

Figure 15A:
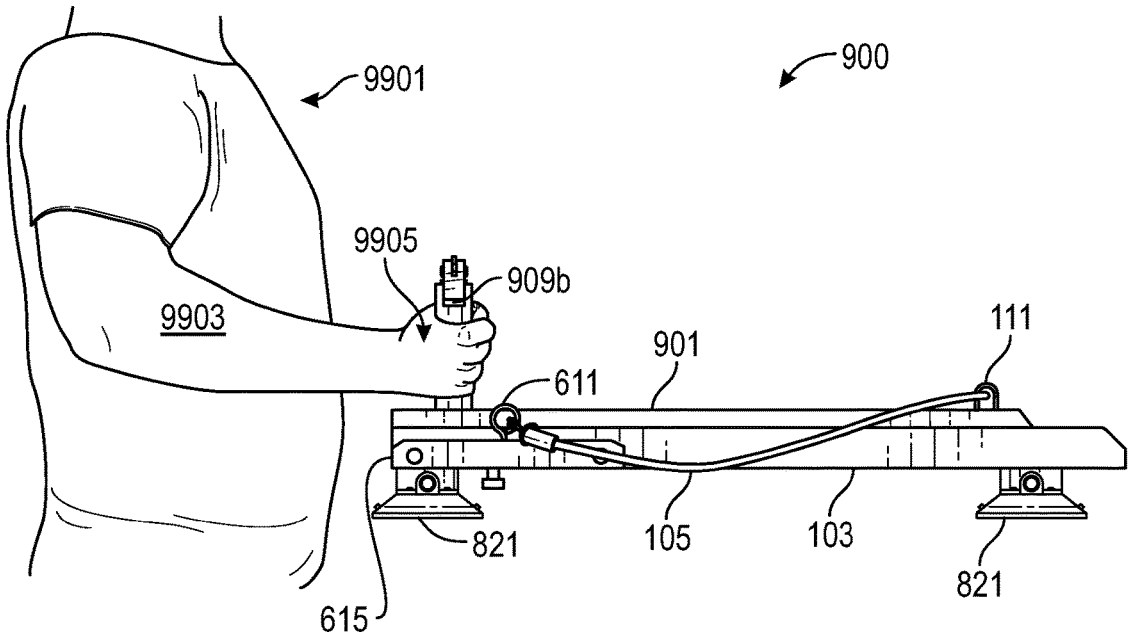
FIG. 15A may show the shoulder exercise machine of FIG. 9, shown from a side view, in use by a user, with no tension on the resistance member.
Figure 15B:
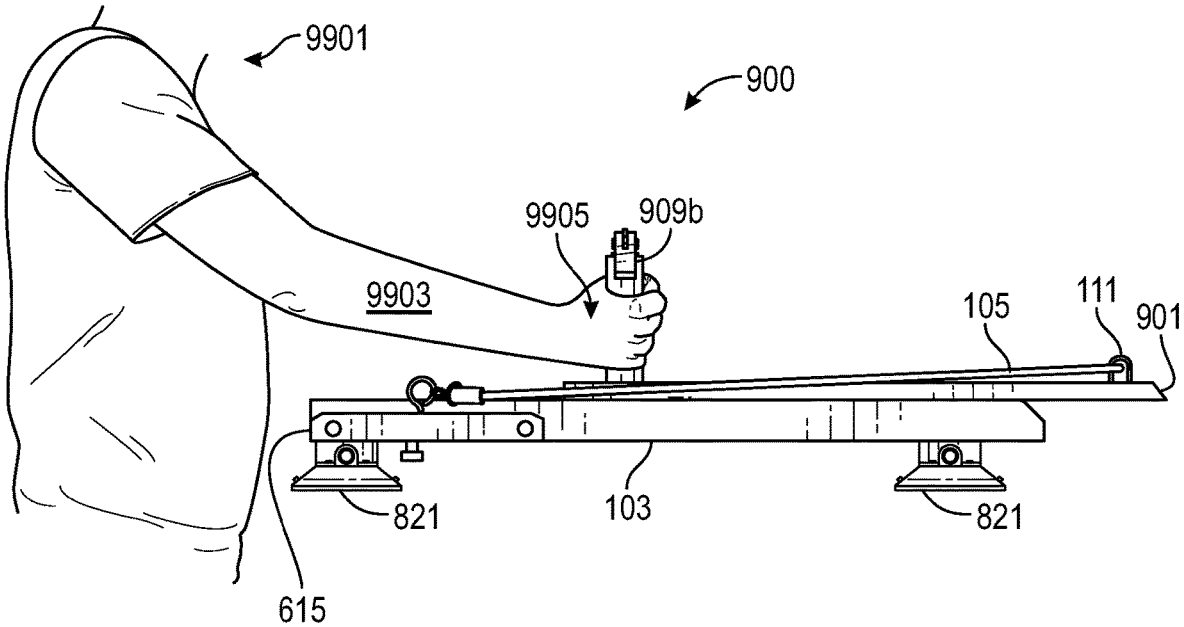
FIG. 15B may show the shoulder exercise machine of FIG. 9, shown from a side view, in use by the user, with at least some tension on the resistance member.

FIG. 15A may show shoulder exercise machine 900, shown from a side view, in use by user 9901, with no tension on the resistance member. FIG. 15B may show shoulder exercise machine 900, shown from a side view, in use by user 9901, with at least some tension on the resistance member. In FIG. 15A and in FIG. 15B, shoulder exercise machine 900 may be resting upon a table top or the like. In FIG. 15A and in FIG. 15B, shoulder exercise machine 900 may be (removably) fixed/attached to the table top or the like (e.g., by use of suction cups 821). In FIG. 15A and in FIG. 15B, a torso/chest/stomach region of user 9901 may be facing shoulder exercise machine 900. In FIG. 15A and in FIG. 15B, an overall length of shoulder exercise machine 900 may be facing and/or extending away from a torso/chest/stomach region of user 9901. In FIG. 15A and in FIG. 15B, the back of shoulder exercise machine 900 may be closest to the stomach region of user 9901. In FIG. 15A and in FIG. 15B, the front of shoulder exercise machine 900 may be disposed (extended) away from the stomach region of user 9901. In FIG. 15A and in FIG. 15B, a right hand 9905 of user 9901 may be gripping vertical handle 913 of handle 909*b*. (User 9901 could have just as easily used left hand 9905 to grip vertical handle 913 of handle 909*b*). In FIG. 15A and in FIG. 15B, for user 9901 to exercise using shoulder exercise machine 900, user 9901 uses at least one hand 9905 to grip handle 909*b* and to then push upper member 901 away from user 9901 (away from lower member 103), which in turn may be cause resistance member 105 to exert resistance to muscles of user 9901, because this motion stretches resistance member 105.

Figure 16A:
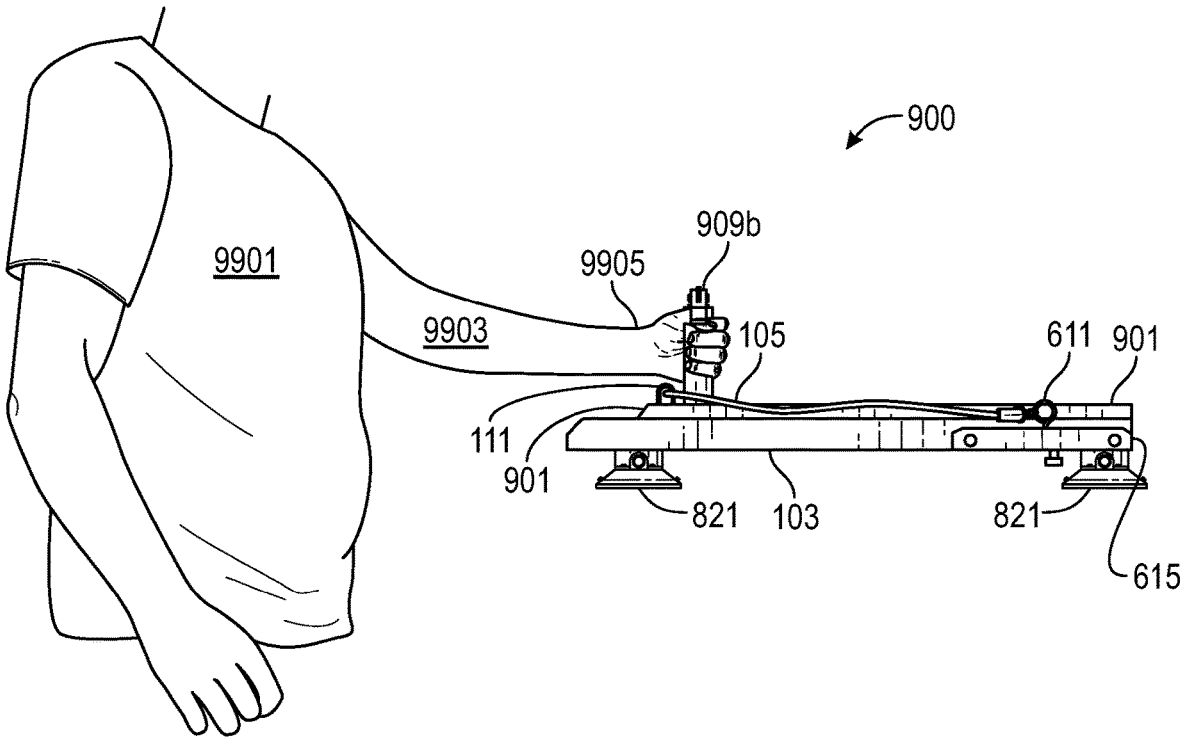
FIG. 16A may show the shoulder exercise machine of FIG. 9, shown from a side view, in use by a user, with no tension on the resistance member.
Figure 16B:
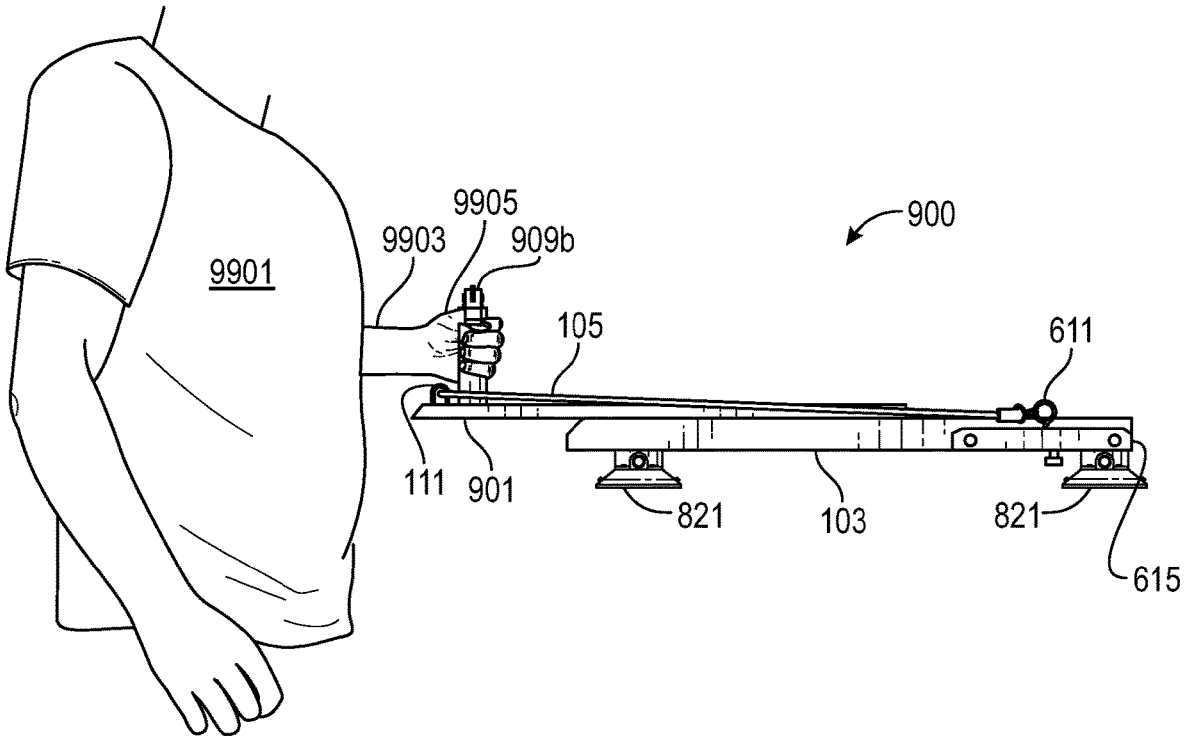
FIG. 16B may show the shoulder exercise machine of FIG. 9, shown from a side view, in use by the user, with at least some tension on the resistance member.

FIG. 16A may show shoulder exercise machine 900, shown from a side view, in use by user 9901, with no tension on the resistance member. FIG. 16B may show shoulder exercise machine 900, shown from a side view, in use by user 9901, with at least some tension on the resistance member. In FIG. 16A and in FIG. 16B, shoulder exercise machine 900 may be resting upon a table top or the like. In FIG. 16A and in FIG. 16B, shoulder exercise machine 900 may be (removably) fixed/attached to the table top or the like (e.g., by use of suction cups 821). In FIG. 16A and in FIG. 16B, a torso/chest/stomach region of user 9901 may be facing shoulder exercise machine 900. In FIG. 16A and in FIG. 16B, an overall length of shoulder exercise machine 900 may be facing and/or extending away from a torso/chest/stomach region of user 9901. In FIG. 16A and in FIG. 16B, the front of shoulder exercise machine 900 may be closest to the stomach region of user 9901 (note, this is an opposite setup as compared to FIG. 14A through FIG. 15B). In FIG. 16A and in FIG. 16B, the back of shoulder exercise machine 900 may be disposed (extended) away from the stomach region of user 9901 (note, this is an opposite setup as compared to FIG. 14A through FIG. 15B). In FIG. 16A and in FIG. 16B, a left hand 9905 of user 9901 may be gripping vertical handle 913 of handle 909*b*. (User 9901 could have just as easily used right hand 9905 to grip vertical handle 913 of handle 909*b*). In FIG. 16A and in FIG. 16B, for user 9901 to exercise using shoulder exercise machine 900, user 9901 uses at least one hand 9905 to grip handle 909*b* and to then pull upper member 901 towards user 9901 (away from lower member 103), which in turn may be cause resistance member 105 to exert resistance to muscles of user 9901, because this motion stretches resistance member 105.

Figure 17A:
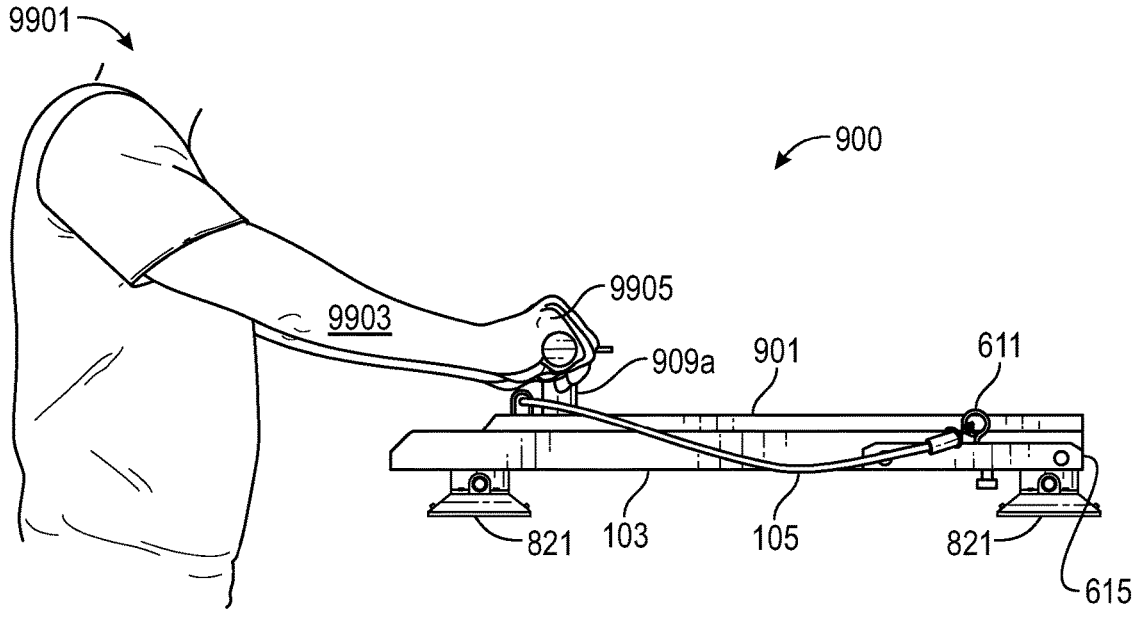
FIG. 17A may show the shoulder exercise machine of FIG. 9, shown from a side view, in use by a user, with no tension on the resistance member.
Figure 17B:
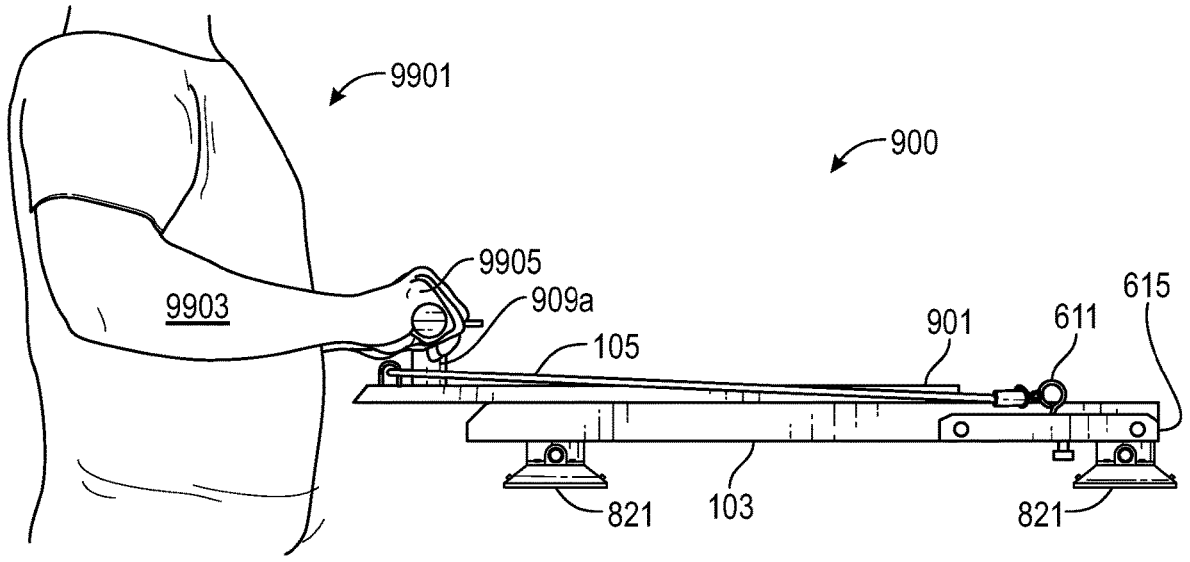
FIG. 17B may show the shoulder exercise machine of FIG. 9, shown from a side view, in use by the user, with at least some tension on the resistance member.

FIG. 17A may show shoulder exercise machine 900, shown from a side view, in use by user 9901, with no tension on the resistance member. FIG. 17B may show shoulder exercise machine 900, shown from a side view, in use by user 9901, with at least some tension on the resistance member. In FIG. 17A and in FIG. 17B, shoulder exercise machine 900 may be resting upon a table top or the like. In FIG. 17A and in FIG. 17B, shoulder exercise machine 900 may be (removably) fixed/attached to the table top or the like (e.g., by use of suction cups 821). In FIG. 17A and in FIG. 17B, a torso/chest/stomach region of user 9901 may be facing shoulder exercise machine 900. In FIG. 17A and in FIG. 17B, an overall length of shoulder exercise machine 900 may be facing and/or extending away from a torso/chest/stomach region of user 9901. In FIG. 17A and in FIG. 17B, the front of shoulder exercise machine 900 may be closest to the stomach region of user 9901 (note, this is an opposite setup as compared to FIG. 14A through FIG. 15B). In FIG. 17A and in FIG. 17B, the back of shoulder exercise machine 900 may be disposed (extended) away from the stomach region of user 9901 (note, this is an opposite setup as compared to FIG. 14A through FIG. 15B). In FIG. 17A and in FIG. 17B, both hands 9905 of user 9901 may be gripping horizontal handles 911 of handle 909*a*. In FIG. 17A and in FIG. 17B, for user 9901 to exercise using shoulder exercise machine 900, user 9901 uses both hands 9905 to grip handle 909*a* and to then pull upper member 901 towards user 9901 (away from lower member 103), which in turn may be cause resistance member 105 to exert resistance to muscles of user 9901, because this motion stretches resistance member 105.

FIG. 18A may show shoulder exercise machine 900, shown from a side view, in use by user 9901, with no tension on the resistance member. FIG. 18B may show shoulder exercise machine 900, shown from a side view, in use by user 9901, with at least some tension on the resistance member. In FIG. 18A and in FIG. 18B, shoulder exercise machine 900 may be resting upon a table top or the like. In FIG. 18A and in FIG. 18B, shoulder exercise machine 900 may be (removably) fixed/attached to the table top or the like (e.g., by use of suction cups 821). In FIG. 18A and in FIG. 18B, a torso/chest/stomach region of user 9901 may be facing shoulder exercise machine 900. In FIG. 18A and in FIG. 18B, an overall width of shoulder exercise machine 900 may be facing and/or extending away from a torso/chest/stomach region of user 9901. In FIG. 18A and in FIG. 18B, the body of user 9901 with respect to shoulder exercise machine 900 may be rotated by about 90 degrees as compared to the body of user 9901 with respect to shoulder exercise machine 900 in figures FIG. 14A through FIG. 17B. In FIG. 18A and in FIG. 18B, a longitudinal side of shoulder exercise machine 900 may be closest to the stomach region of user 9901; and the opposing longitudinal side of shoulder exercise machine 900 may be disposed (facing) away from the stomach region of user 9901. In FIG. 18A and in FIG. 18B, a right hand 9905 of user 9901 may be gripping vertical handle 913 of handle 909*b*. (User 9901 could have just as easily used left hand 9905 to grip vertical handle 913 of handle 909*b*). In FIG. 18A and in FIG. 18B, for user 9901 to exercise using shoulder exercise machine 900, user 9901 uses at least one hand 9905 to grip handle 909*b* and to then push upper member 901 across a front of user 9901 (away from lower member 103), which in turn may be cause resistance member 105 to exert resistance to muscles of user 9901, because this motion stretches resistance member 105.

Figure 19A:
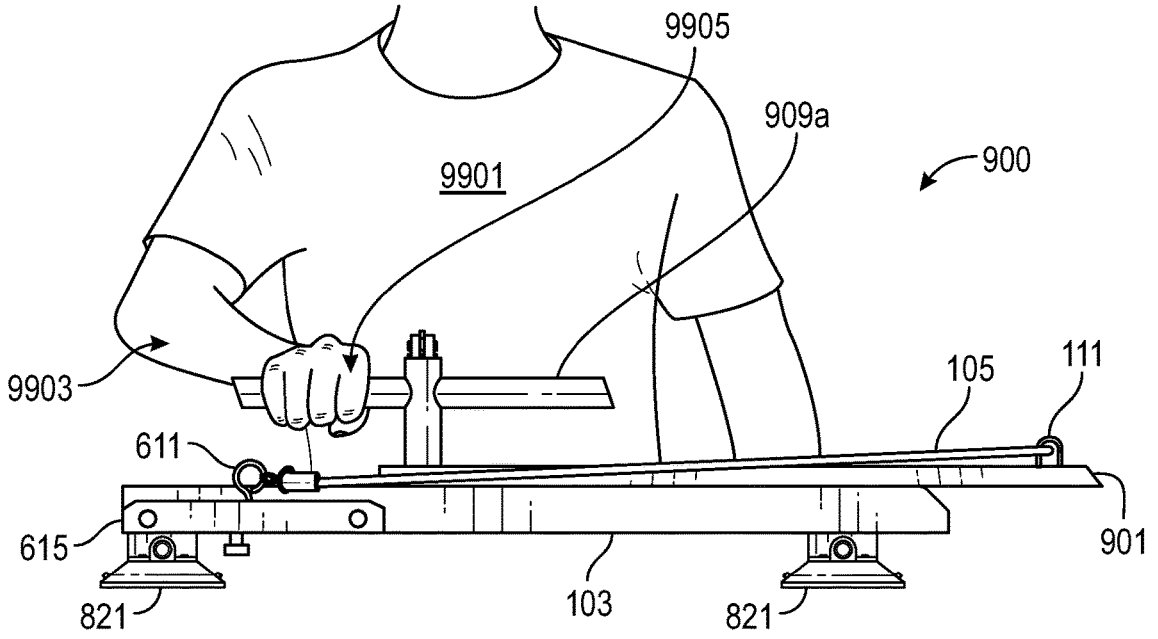
FIG. 19A may show the shoulder exercise machine of FIG. 9, shown from a side view, in use by a right hand of the user, with at least some tension on the resistance member.
Figure 19B:
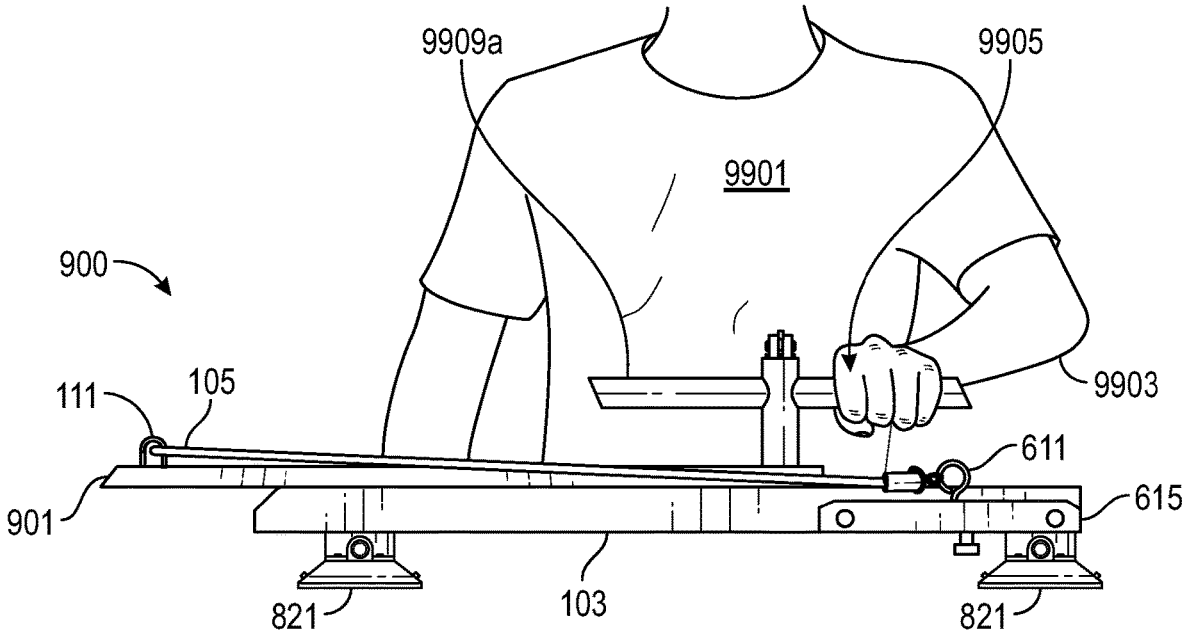
FIG. 19B may show the shoulder exercise machine of FIG. 9, shown from a side view, in use by a left hand of the user, with at least some tension on the resistance member.

FIG. 19A may show shoulder exercise machine 900, shown from a side view, in use by a right hand 9905 of the user 9901, with at least some tension on the resistance member. FIG. 19B may show shoulder exercise machine 900, shown from a side view, in use by a left hand 9905 of the user 9901, with at least some tension on the resistance member. Thus, FIG. 19A and FIG. 19B are just one visual example of how shoulder exercise machine 900 may be used with either hand 9905 of user 9901. In FIG. 19A and in FIG. 19B, an overall width of shoulder exercise machine 900 may be facing and/or extending away from a torso/chest/stomach region of user 9901. In FIG. 19A and in FIG. 19B, the body of user 9901 with respect to shoulder exercise machine 900 may be rotated by about ninety (90) degrees as compared to the body of user 9901 with respect to shoulder exercise machine 900 in figures FIG. 14A through FIG. 17B. In FIG. 19A and in FIG. 19B, a longitudinal side of shoulder exercise machine 900 may be closest to the stomach region of user 9901; and the opposing longitudinal side of shoulder exercise machine 900 may be disposed (facing) away from the stomach region of user 9901.

Note with respect to the materials of construction, it is not desired nor intended to thereby unnecessarily limit the present invention by reason of such disclosure.

Shoulder exercise machines have been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A machine for exercising comprising:

an upper member with a width, wherein the upper member comprises a channel and an upper-member-upper-surface that is an upper surface of the upper member, wherein the channel is located on the upper-member-upper-surface;

a lower member; wherein the upper member and the lower member are slidingly engaged with each other, such that the upper member is configured to slide linearly back and forth on top of the lower member during exercising use of the machine; and at least one resistance member that provides resistance with respect to the upper member sliding against the lower member, wherein the at least one resistance member is an elongate elastic member with two opposing terminal ends;

wherein the lower member comprises at least two anchors for fixedly anchoring the two opposing terminal ends of the at least one resistance member to the lower member;

wherein the at least two anchors are disposed opposite of each other on the lower member, separated from each other by the width of the upper member, with the upper member located between the at least two anchors, such that the two opposing terminal ends of the at least one resistance member are also separated from each other by the width of the upper member.

2. The machine according to claim 1, wherein a portion of the upper-member-upper-surface is configured to support at least a portion of a lower forearm of a user during exercising use of the machine.

3. The machine according to claim 1, wherein the machine further comprises at least one handle, wherein a portion of the at least one handle is configured to be retained within the channel.

4. The machine according to claim 3, wherein the at least one handle comprises a lever and a friction knob, wherein the lever and the friction knob are physically and operatively linked to each other, wherein at least a portion of the friction knob is the portion of the at least one handle that is configured to be retained within the channel, wherein when the lever is loose the at least one handle is slidable along the channel and when the lever is tight the at least one handle is fixed to the channel using friction that prevents sliding of the at least one handle with respect to the channel.

5. The machine according to claim 4, wherein the at least one handle comprises two horizontal handle members, wherein the two horizontal handle members are configured to be gripped by one or both hands of a user of the machine, wherein the two horizontal handle members are disposed between the lever and the friction knob, wherein when the at least one handle is attached to the channel, a length of the two horizontal members is substantially parallel with a main plain of the upper-member-upper-surface.

6. The machine according to claim 5, wherein when the lever is loose the at least the portion of the friction knob is retained within the channel, the two horizontal handle members are rotatable around the friction knob.

7. The machine according to claim 4, wherein the at least one handle comprises a vertical handle member, wherein the vertical handle member is configured to be gripped by at least one hand of a user of the machine, wherein the vertical handle member is disposed between the lever and the friction knob, wherein when the at least one handle is attached to the channel, a length of the vertical member is substantially orthogonal with a main plain of the upper-member-upper-surface.

8. The machine according to claim 1, wherein the upper-member-upper-surface is substantially planar.

9. The machine according to claim 1, wherein at least a portion of the upper-member-upper-surface is covered by padding.

10. The machine according to claim 1, wherein the upper member comprises at least one retainer guide for retaining a portion of the at least one resistance member disposed away from the two opposing terminal ends of the at least one resistance member, wherein the at least one retainer guide permits sliding translation of the portion of the at least one resistance member through the at least one retainer guide.

11. The machine according to claim 1, wherein the upper member comprises an upper-member-lower-surface that is a lower surface of the upper member; wherein a portion of the upper-member-lower-surface comprises a first sliding mechanism that complimentary mates with a second sliding mechanism of the lower member, wherein the lower member comprises the second sliding mechanism; wherein the complimentary mating between the first sliding mechanism and the second sliding mechanism provides for the sliding engagement between the upper member and the lower member.

12. The machine according to claim 11, wherein the first sliding mechanism and the second sliding mechanism are of a rail and of a rail-receiving-channel relationship.

13. The machine according to claim 11, wherein the first sliding mechanism and the second sliding mechanism run in a direction that is parallel with an overall length of the machine; wherein the first sliding mechanism and the second sliding mechanism are both located along a longitudinal center of the machine that equally bisects the width of the upper member.

14. The machine according to claim 11, wherein the first sliding mechanism and the second sliding mechanism are disposed equally between the at least two anchors.

15. The machine according to claim 1, wherein the upper member comprises an upper-member-lower-surface that is a lower surface of the upper member; wherein the upper-member-lower-surface comprises at least one stop; wherein the lower member comprises at least one different stop; wherein the at least one stop and the at least one different stop are configured to removably contact each other; wherein when the at least one stop and the at least one different stop are contacting each other sliding translation between the upper member and the lower member in one direction is prevented.

16. The machine according to claim 1, wherein the lower member comprises a pair of anchor-support-blocks disposed opposite of each other; wherein each of the anchor-support-blocks selected from the pair of anchor-support-blocks comprises at least one of the anchors selected from the at least two anchors.

17. The machine according to claim 1, wherein the lower member comprises a lower-member-lower-surface; wherein the lower-member-lower-surface comprises at least two feet, wherein the at least two feet are configured to support the machine.

18. The machine according to claim 17, wherein the at least two feet are suction cups that are configured to removably stick to a substrate.

19. The machine according to claim 1, wherein the lower member comprises a pair of oppositely disposed supports-for-upper-members that support the upper member; wherein the supports-for-upper-members are raised a predetermined and equal distance above a lower-member-upper-surface that is an upper surface of the lower member.

20. The machine according to claim 1, wherein each of the two opposing terminal ends of the at least one resistance member removably attaches to one of the anchors selected from the at least two anchors of the lower member; and wherein a portion of the at least one resistance member disposed away from the two opposing terminal ends passes through at least one retainer guide of the upper member such that there is resistance with respect to sliding translation between the upper member and the lower member; wherein the at least two anchors are disposed away from the at least one retainer guide.

* * * * *